US011846217B2

(12) United States Patent
Zhang et al.

(10) Patent No.: US 11,846,217 B2
(45) **Date of Patent: *Dec. 19, 2023**

(54) AIR-TRANSPARENT SELECTIVE SOUND SILENCER USING ULTRA-OPEN METAMATERIAL

(71) Applicant: Trustees of Boston University, Boston, MA (US)

(72) Inventors: Xin Zhang, Medford, MA (US); Reza Ghaffarivardavagh, Boston, MA (US); Stephan Anderson, Boston, MA (US)

(73) Assignee: Trustees of Boston University, Boston, MA (US)

( * ) Notice: Subject to any disclaimer, the term of this patent is extended or adjusted under 35 U.S.C. 154(b) by 354 days.

This patent is subject to a terminal disclaimer.

(21) Appl. No.: 17/112,833

(22) Filed: Dec. 4, 2020

(65) Prior Publication Data

US 2021/0087957 A1 Mar. 25, 2021

Related U.S. Application Data

(63) Continuation of application No. 16/530,662, filed on Aug. 2, 2019, now Pat. No. 10,947,876.

(Continued)

(51) Int. Cl.

| | |
|---|---|
| ***F01N 1/06*** | (2006.01) |
| ***F01N 1/12*** | (2006.01) |
| ***F01N 1/08*** | (2006.01) |

(52) U.S. Cl.

CPC ..... *F01N 1/06* (2013.01); *F01N 1/086* (2013.01); *F01N 1/087* (2013.01); *F01N 1/088* (2013.01); *F01N 1/12* (2013.01)

(58) Field of Classification Search

CPC ... F01N 1/12; F01N 1/06; F01N 1/086; F01N 1/087; F01N 1/088

(Continued)

(56) References Cited

U.S. PATENT DOCUMENTS

| | | | |
|---|---|---|---|
| 1,612,584 | A | 12/1926 | Hunter et al. |
| 1,740,805 | A | 12/1929 | Henry |

(Continued)

FOREIGN PATENT DOCUMENTS

| | | | |
|---|---|---|---|
| CN | 203594488 | U | 5/2014 |
| CN | 106481385 | A | 3/2017 |

(Continued)

OTHER PUBLICATIONS

Indian Patent Office, First Examination Report for Indian Patent Application No. 202117002665 dated Jul. 29, 2022 (7 pages).

(Continued)

*Primary Examiner* — Jeremy A Luks

(74) *Attorney, Agent, or Firm* — Nutter McClennen & Fish LLP

(57) ABSTRACT

A bilayler metamaterial silencer allows substantial fluid through the apparatus, while mitigating the propagation of sound through the apparatus, and while providing a form factor that is significantly more compact than previously-known devices. Moreover, illustrative embodiments allow a designer to specify one or both of the frequency or frequencies at which the apparatus mitigates sound propagation, and/or the bandwidth around the frequency or frequencies at which the apparatus mitigates sound propagation.

10 Claims, 17 Drawing Sheets
(15 of 17 Drawing Sheet(s) Filed in Color)

Related U.S. Application Data

(60) Provisional application No. 62/863,046, filed on Jun. 18, 2019, provisional application No. 62/714,246, filed on Aug. 3, 2018.

(58) Field of Classification Search
USPC ..... 181/232, 279, 280
See application file for complete search history.

(56) References Cited

U.S. PATENT DOCUMENTS

| | | | | |
|---|---|---|---|---|
| 2,317,246 | A | 4/1943 | Bergmann | |
| 2,359,365 | A | 10/1944 | Katcher | |
| 2,911,055 | A | 11/1959 | McDonald | |
| 3,113,635 | A | 12/1963 | Allen et al. | |
| 3,700,069 | A | 10/1972 | Rausch et al. | |
| 3,805,495 | A | 4/1974 | Steel | |
| 3,888,331 | A | 6/1975 | Wang | |
| 3,913,703 | A | 10/1975 | Parker | |
| 3,963,092 | A | 6/1976 | Soares | |
| 4,050,539 | A | 9/1977 | Kashiwara et al. | |
| 4,683,978 | A | 8/1987 | Venter | |
| 5,152,366 | A | 10/1992 | Reitz | |
| 5,245,140 | A * | 9/1993 | Wu | F01N 1/02 181/232 |
| 5,783,780 | A | 7/1998 | Watanabe et al. | |
| 6,364,055 | B1 | 4/2002 | Purdy | |
| 6,772,858 | B2 | 8/2004 | Trochon | |
| 7,117,973 | B2 | 10/2006 | Graefenstein | |
| 7,661,509 | B2 | 2/2010 | Dadd | |
| 7,726,444 | B1 | 6/2010 | Laughlin | |
| 9,500,108 | B2 | 11/2016 | Brown | |
| 10,947,876 | B2 * | 3/2021 | Zhang | F01N 1/086 |
| 2001/0015301 | A1 | 8/2001 | Kesselring | |
| 2016/0201530 | A1 | 7/2016 | Brown | |
| 2018/0000257 | A1 | 1/2018 | Poppe | |
| 2018/0025714 | A1 | 1/2018 | Kikuchi et al. | |

FOREIGN PATENT DOCUMENTS

| | | | |
|---|---|---|---|
| DE | 3401210 | A1 | 7/1985 |
| DE | 19543967 | A1 | 5/1997 |
| DE | 10328144 | A1 | 1/2005 |
| EP | 1070903 | A1 | 1/2001 |
| FR | 602160 | A | 3/1926 |
| GB | 460148 | A | 1/1937 |
| GB | 915295 | A | 1/1963 |
| JP | S5194538 | U | 7/1976 |
| JP | S57191409 | A | 11/1982 |
| JP | 2005-513355 | A | 5/2005 |
| JP | 2008050989 | A | 3/2008 |

OTHER PUBLICATIONS

Alfredson, R.J., et al., "The Radiation of Sound From An Engine Exhaust," J. Sound Vib., vol. 13, Issue No. 4, pp. 389-408 (1970).

Chen, H., et al., "Acoustic cloaking in three dimensions using acoustic metamaterials," American Institute of Physics, Applied Physics Letters vol. 91, pp. 183518-1 to 183518-3 (2007).

Chen, Z., et al., "An open-structure sound insulator against low-frequency and wide-band acoustic waves," Applied Physics Express, vol. 8, pp. 107301-1 to 107301-4 (2015).

Cummer, S.A., et al., "Scattering Theory Derivation of a 3D Acoustic Cloaking Shell," Physical Review Letters, vol. 100, pp. 024301-1 to 024301-4 (2008).

Esfahlani, H., et al., "Generation of acoustic helical wavefronts using metasurfaces," American Physical Society, Physical Review B, vol. 95, pp. 024312-1 to 024312-5 (2017).

Fano, U., "Effects of Configuration Interaction on Intensities and Phase Shifts," Physical Review, vol. 124, Issue No. 6, pp. 1866-1878 (Dec. 1961).

Fellay, A., et al., "Scattering of vibrational waves in perturbed quasi-one-dimensional multichannel waveguides," The American Physical Society, Physical Review B, vol. 55, Issue No. 3, pp. 1707-1717 (Jan. 1997).

Feng, Q., et al., "Acoustic attenuation performance through a constricted duct improved by an annular resonator," The Journal of the Acoustical Society of America, vol. 134, Issue No. 4, pp. EL345 to EL351 (Oct. 2013).

Garcia-Chocano, V.M., et al., "Broadband sound absorption by lattices of microperforated cylindrical shells," Applied Physics Letters, vol. 101, pp. 184101-1 to 184101-4 (2012).

Ghaffarivardavagh, R., et al., "Horn-like space-coiling metamaterials toward simultaneous phase and amplitude modulation," Nature Communications, vol. 9, Issue No. 1349, pp. 1-8 (2018).

Goffaux, C., et al., "Evidence of Fano-Like Interference Phenomena in Locally Resonant Materials," Physical Review Letters, vol. 88, Issue No. 22, pp. 225502-1 to 225502-4 (Jun. 2002).

Huang, L., "Broadband sound reflection by plates covering side-branch cavities in a duct," The Journal of the Acoustical Society of America, vol. 119, No. 5, pp. 2628-2638 (May 2006).

Jung, J.W., et al., "Acoustic metamaterial panel for both fluid passage and broadband soundproofing in the audible frequency range," Applied Physics Letters, vol. 112, pp. 041903-1 to 041903-5 (2018).

Kim, S.H., et al., "Air transparent soundproof window," AIP Advances, vol. 4, pp. 117123-1 to 117123-8 (2014).

Lauchle, G.C., et al., "Active control of axial-flow fan noise," The Journal of the Acoustical Society of America, vol. 101, Issue No. 1, pp. 341-349 (Jan. 1997).

Lee, J.W., et al., "Topology design of a reactive mufflers for enhancing their acoustic attenuation performance and flow characteristics simultaneously," International Journal for Numerical Methods in Engineering, vol. 91, pp. 552-570 (2012).

Li, L.J., "Broadband compact acoustic absorber with high-efficiency ventilation performance," Applied Physics etters, vol. 113, p. 103501-1 to 103501-5 (2018).

Li, Y., et al., "Experimental Realization of Full Control of Reflected Waves with Subwavelength Acoustic Metasurfaces," Physical Review Applied, vol. 2, pp. 064002-1 to 064002-11 (2014).

Li, Y., et al., "Three-dimensional Ultrathin Planar Lenses by Acoustic Metamaterials," Scientific Reports, vol. 4, Issue No. 6830, pp. 1-6 (2014).

Lu, D., et al., "Hyperlenses and metalenses for far-field super-resolution imaging," Nature Communications, vol. 3, 1205, pp. 1-9 (Nov. 2012).

Ma, G., et al., "Low-frequency narrow-band acoustic filter with large orifice," Applied Physical Letters, vol. 103, pp. 011903-1 to 011903-4 (2013).

Niu, Y., et al., "Three dimensional visualizations of open fan noise fields," Noise Control Engr. J., vol. 60, Issue No. 4, pp. 392-404 (Juy-Aug. 2012).

Sainidou, R., et al., "Guided quasiguided elastic waves in phononic crystal slabs," The American Physical Society, Physical Review B, vol. 73, pp. 184301-1 to 184301-7 (2006).

Selamet, A., et al., "Acoustic Attenuation Performance of Circular Expansion Chambers with Extended Inlet/ Outlet," Journal of Sound and Vibration, vol. 223, Issue No. 2, pp. 197-212 (1999).

Sellen, N., et al., "Noise reduction in a flow duct: Implementation of a hybrid passive/active solution," Journal of Sound and Vibration, vol. 297, pp. 492-511 (2006).

Shen, C., et al., "Acoustic metacages for sound shielding with steady air flow," Journal of Applied Physics, vol. 123, p. 124501-1 to 124501-7 (2018).

Stewart, G.W., "The Theory of the Herschel-Quincke Tube," Physical Review, vol. 31, pp. 696-698 (Apr. 1928).

Wang, C., et al., "Realization of a broadband low-frequency plate silencer using sandwich plates," Journal of Sound and Vibration, vol. 318, pp. 792-808 (2008).

Wu, X., et al., "High-efficiency ventilated metamaterial absorber at low frequency," Applied Physics Letters, vol. 112, pp. 103505-1 to 103505-5 (2018).

Xie, Y., et al., "Wavefront modulation and subwavelength diffractive acoustics with an acoustic metasurface," Nature Communications, vol. 5, 5553, pp. 1-5 (2014).

(56) References Cited

OTHER PUBLICATIONS

Zhu, J., et al., "A holey-structured metamaterial for acoustic deep-subwavelength imaging," Nature Physics, vol. 7, pp. 52-55 (Jan. 2011).
Zhu, X., et al., "Implementation of dispersion-free slow acoustic wave propagation and phase engineering with helical-structured metamaterials," Nature Communications, vol. 7, 11731, pp. 1-7 (2016).
International Search Report and Written Opinion for Application No. PCT/US2019/044957, dated Nov. 1, 2019, 16 pages.
Ghaffarivardavagh, R., et al., "Ultra-open acoustic metamaterial silencer based on Fano-like interference," Physical Review B, vol. 99, pp. 024302-1-024302-10 (2019).
Chinese Office Action and Search Report for Application 2019800511991, dated Mar. 11, 2022, 13 pages.
Extended European Search Report for Application No. 19843488.8, dated Mar. 30, 2022 (8 pages).
Japanese Patent Office, Notification of Reasons for Rejection, for Japanese Patent Application No. 2021-505838, dated Apr. 26, 2023, 18 pages.

* cited by examiner

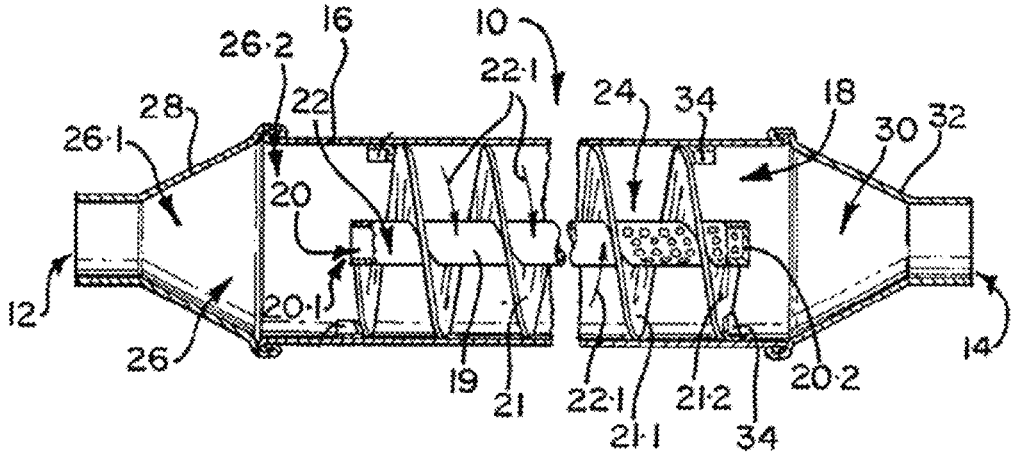
Fig. 1A (Prior Art) US 4,683,978
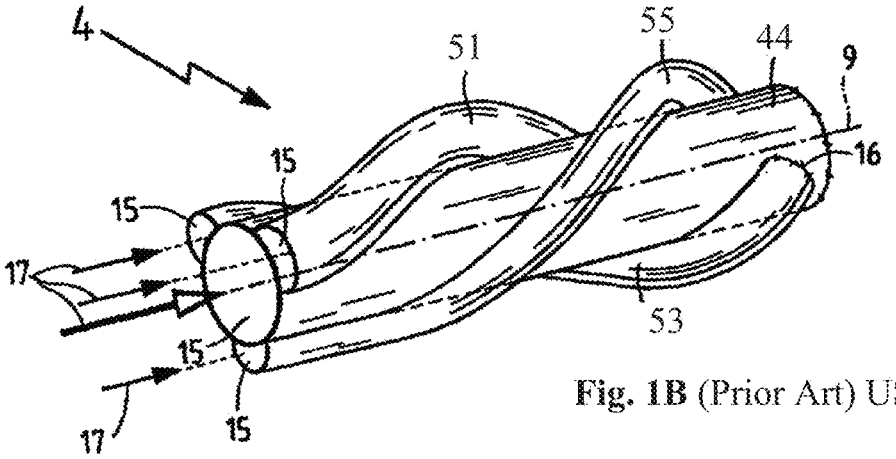
Fig. 1B (Prior Art) US 7,117,973
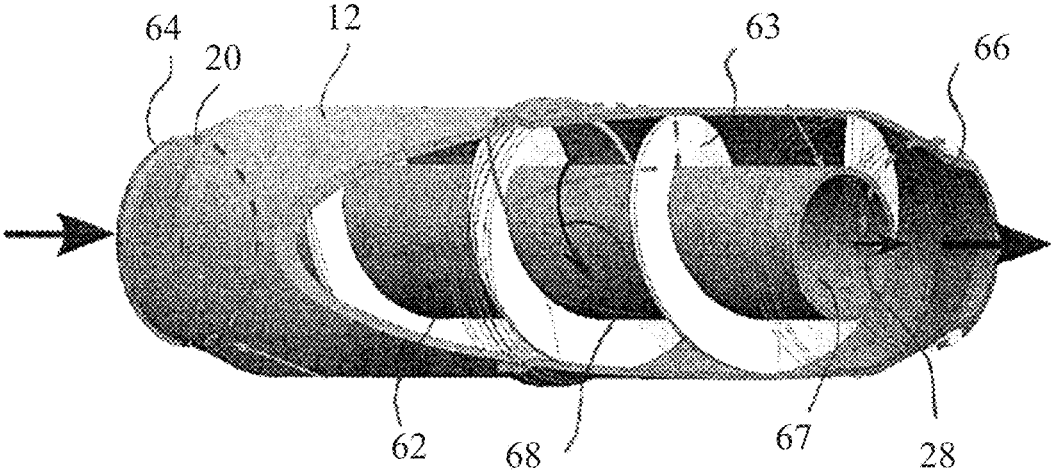
Fig. 1C (Prior Art) US 9,500,108

AIR-TRANSPARENT SELECTIVE SOUND SILENCER USING ULTRA-OPEN METAMATERIAL

RELATED APPLICATIONS

This patent application is a continuation of U.S. Non-Provisional application Ser. No. 16/530,662, filed Aug. 2, 2019, entitled "Air-Transparent Selective Sound Silencer Using Ultra-Open Metamaterial", naming Xin Zhang, Reza Ghaffarivardavagh, and Stephan Anderson as inventors, which claims priority to U.S. Provisional Application No. 62/863,046, filed Jun. 18, 2019 and titled "Air-Transparent Selective Sound Silencer Using Ultra-Open Metamaterial" and U.S. Provisional Application No. 62/714,246, filed Aug. 3, 2018 and titled "Air-Transparent Selective Sound Silencer Using Ultra-Open Metamaterial." The disclosures of each of the foregoing applications are incorporated herein, in their entireties, by reference.

TECHNICAL FIELD

The present disclosure relates to devices for sound suppression, and more particularly, to devices that also allow air flow through the device while suppressing sound transmission through the device.

BACKGROUND ART

It is known to suppress propagation of sound by a variety of means, such as sound-absorbing insulation and sound-deflecting surfaces. Some devices, such as noise-canceling headphones for example, dampen propagation of undesirable sound by combining that undesirable sound with a copy of that sound, which copy is the inverse of the undesirable sound.

If the undesirable sound has a known frequency, some devices dampen the undesirable sound at that specific frequency by combining the undesirable sound with an inverted copy of that sound (e.g., a copy that is inver180 degrees out of phase with the undesirable sound).

A species of some such prior art devices is known as a "Herschel-Quincke tube" (or "HQ tube"). An HQ tube has a first duct through which sound may propagate, and a second duct through which sound may propagate. A propagating sound signal enters both the first duct and the second duct, and propagates through both ducts until the ducts meet, and the signal propagating through the second duct merges with the signal propagating through the first duct.

The ability of an HQ tube to reduce a sound signal propagating in a medium, at a given frequency having a corresponding wavelength ($\lambda$), arises not from the length of the first duct (L1), nor from the length of the second duct (L2), but instead on the difference between the length of the first duct and the length of the second duct (i.e., L2–L1). In an HQ tube, the difference in length between the first duct the second duct (i.e., L2–L1) is one-half of the wavelength ($0.5\lambda$) (or $N\lambda+0.5\lambda$, where N is an integer) of the frequency of the sound signal, so that the point where the ducts meet and their respective signal merge, the signal propagating in the second duct is 180 degrees out of phase with the signal in the first duct. For example, a first duct may have a length of $1.25\lambda$ and the second duct may have a length of $1.75\lambda$, so that the difference between those lengths is $1.75\lambda-1.25\lambda=0.5\lambda$.

Among other things, this means that the manufacture of an HQ tube requires that both ducts be fabricated to a high degree of precision, to assure the required difference between their respective lengths. Moreover, such devices require a tradeoff between the quantity of open space through which a fluid can flow, and their ability to dampen sound transmission (i.e., their transmission loss). In other words, the amount of open area is sacrificed to obtain desired acoustic performance.

Some examples of prior art HQ tubes are described below.

FIG. 1A schematically illustrates a prior art exhaust silencer according to the first figure of U.S. Pat. No. 4,683,978 to Venter.

In Venter's device (FIG. 1A), reference numeral 10 refers generally to an exhaust silencer for an internal combustion engine. The exhaust silencer 10 has an inlet opening 12 and an outlet opening 14 spaced axially from the inlet opening 12. The silencer includes a cylindrical shell (or casing) 16, and a core 18 inside the shell 16. The core includes a central axial tube 19 which defines at least one axial flow passage 20. The core has at least one helical baffle 21 which defines a helical passage 22 around the axial passage 20, within the shell 16. The axial flow passage 20 has an upstream axial inlet 20.1 and has a transverse outlet 24 directed transversely outwardly into the helical passage 22 in the downstream half of the helical passage. The transverse outlet 24 is provided by a plurality of openings arranged as a cluster at the downstream end of the axial passage 20, and between the last two vanes 21.1 and 21.2 of the helical baffle 21.

Venter's silencer 10 has an inlet chamber 26 which includes a frusto-conical shaped part 26.1 defined by a funnel-shaped inlet connection 28, which has an axial length, about half the diameter of the cylindrical shell 16. The inlet chamber also has a cylindrical part 26.2 which has an axial length about half the diameter of the cylindrical shell 16. Likewise, the silencer has an outlet chamber 30 extending downstream from the helical passage, also of frusto-conical shape defined by a funnel-shaped outlet connection 32 which also has an axial length, about half the diameter of the cylindrical shell 16. The baffle 21 is wound wormscrew fashion around the central axial tube 19 in order to define the helical passage 20. The upstream open end 20.1 of the axial flow passage, is disposed at the downstream end of the cylindrical part 26.2 of the inlet chamber 26. The central axial tube 19 defining the axial flow passage 20, is blanked off by a transverse barrier 20.2 aligned with its upstream axial inlet 20.1 and downstream from its transverse outlet 24.

As shown, Venter's axial flow passage 20 is capped by its transverse barrier 20.2, and a wave propagating through Venter's axial flow passage 20 can only exit the axial flow passage 20 in a radial direction, through the holes of its transverse outlet 24, which outlet is within the confines of its cylindrical shell (or casing) 16. Consequently, the joining of a wave propagating through the axial flow passage 20 and a wave propagating through its helical passage 22 can occur only within the silencer 10. As such, the junction of Venter's axial flow passage 20 and its helical passage 22 may be may be described as being "ducted.".

FIG. 1B schematically illustrates a prior art noise suppressor for a gas duct 4 according to the second figure of U.S. Pat. No. 7,117,973 to Graefenstein.

Graefenstein's duct 4 includes a central pipe 44, and with three spiral channels 51, 53, 55, in contact with the outside lateral surface of pipe 44.

As shown in FIG. 1B, spiral channels 51, 53, 55 join the central pipe 44 in an axial direction (outlet opening 16).

Consequently, the joining of a wave propagating through Graefenstein's central pipe 44 and a wave propagating through its three spiral channels 51, 53, 55 can occur only within the central pipe 44. As such, the junction of Graefenstein's central pipe 44 and its spiral channels 51, 53, 55 may be described as being "ducted."

FIG. 1C schematically illustrates a prior art split path silencer 10. according to the first figure of U.S. Pat. No. 9,500,108 to Brown. Brown's silencer 10 includes an outer shell 12 having an inlet opening 64 (with ramped section 20) and an outlet opening 66. Within the outer shell 12, Brown's silencer 12 includes a baffle 63 wound around an inner tube 62. Sound may propagate through the inner tube 62 in a direction 28, and sound may travel through the channel defined by the baffle 63 in a direction 68. The inner tube 62 has an exit opening 67 positioned proximate to, but a distance away from, the outlet opening 66 of the outer shell 12.

As shown in FIG. 1C, the channel formed by Brown's baffle 63 exits into a space within the shell (or casing) 12. Consequently, the joining of a wave propagating through Brown's inner tube 62 and a wave propagating through the channel formed by its baffle 63 can occur only within the shell (or casing) 12. As such, the junction of Brown's inner tube 62 and the channel formed by its baffle 63 may be described as being "ducted."

SUMMARY OF VARIOUS EMBODIMENTS

In accordance with illustrative embodiments, a silencer apparatus has a first transmission region and a second transmission region, each open to receive an impinging wave (e.g., an acoustic signal having a spectrum that includes a target frequency, propagating in a fluid medium such as a gas or liquid).

The first transmission region has an inlet (first inlet) and an outlet (first outlet), and is open propagation of the wave thereghrough from the first inlet to the first outlet, and to flow of fluid thereghrough from the first inlet to the first outlet. To those ends, the first transmission region has an area (A1) in cross-section. The first transmission region is configured such that the wave propagating through the first region remains in a continuum state. In some embodiments, the first transmission region is configured so that it does not resonate at the target frequency.

The second transmission region has an inlet (second inlet) and an outlet (second outlet) and is open propagation of the wave thereghrough from the second inlet to the second outlet. In illustrative embodiments, the second transmission region is configured to resonate at the target frequency. The second transmission region has an area (A2) in cross-section.

The second transmission region is disposed relative to the first transmission region such that the wave exiting the second outlet is capable of destructively interfering at the target frequency with the wave exiting the first transmission region. In illustrative embodiments, the wave exiting the second outlet destructively interferes at the target frequency with the wave exiting the first transmission region to dampen the impinging wave by 94% (or 24 dB).

In illustrative embodiments, the first area (A1) in cross-section is larger than the second area (A2) in cross-section such that the apparatus has an openness ratio of at least 0.6 [i.e., A1/(A1+A2) is equal to or greater then 0.6]. Some embodiments are configured to have an openness ratio of 0.8 or more, including up to 0.99, while maintaining the above-mentioned ability to dampen the impinging signal.

In some embodiments, each of the second outlets is disposed such that the signal exits the second outlet in an axial direction. In such embodiments, energy from the exiting signal does not radially enter the first transmission region.

Moreover, in some embodiments, each of the second outlets is disposed such that the signal exits the second outlet into an unbounded space. Some embodiments are un-ducted, in that the apparatus does not have an integral duct at its downstream side, so that the signal exits the silencer into un-ducted space.

A first illustrative embodiment of an apparatus comprises a first channel having a first inlet and a first outlet, the first channel open to propagation of a first wave at a target frequency therethrough and having a first area in cross-section, and one or more second channels each open to the propagation of a second wave at the target frequency therethrough, and each having a second inlet and a second outlet, the one or more second channels defining a second area in cross-section, wherein each of the one or more second channels is disposed relative to the first channel such that the second wave at the target frequency exiting the one or more second outlets is capable of destructively interfering with the first wave at the target frequency exiting the first channel, and wherein the first area in cross-section is larger than the second area in cross-section such that the apparatus has an openness ratio of at least 0.6.

In some embodiments, the first channel is open to a flow of fluid therethrough.

In some embodiments, the first area in cross-section is larger than the second area in cross-section such that the apparatus has an openness ratio of at least 0.8. In some such embodiments, the apparatus has an openness ratio of 0.99.

In some embodiments, the first channel defines an axis of fluid flow therethrough, and each second outlet is an un-ducted outlet.

In some embodiments, wherein the first channel defines an axis of fluid flow therethrough, and each second outlet is an axially-oriented outlet, and in some such embodiments each second outlet is an un-ducted outlet.

In some embodiments, each of the first wave and the second wave is a sound wave, and the destructive interference dampens the first wave at the target frequency by at least 94%. In some embodiments, acoustic energy at the target frequency exiting each second outlet destructively interferes with acoustic energy exiting the first channel to dampen sound at the target frequency by at least 24 dB.

Another embodiment of an apparatus comprises a first channel open to the propagation of a first wave at a target frequency therethrough, and having a first inlet and a first outlet, and one or more second channels each having a second inlet and a second outlet, the one or more second channels extending along an axis defining an axial direction, and open to propagation of a second wave at the target frequency therethrough, wherein the one or more second outlets open in the axial direction, and wherein the one or more second channels is disposed, relative to the first channel, such that the second wave at the target frequency exiting the one or more second outlets is capable of destructively interfering with the first wave at the target frequency exiting the first channel.

In some of those embodiments, each of the one or more second channels is configured to resonate at the target frequency, and the first channel is configured to remain in a continuum state during propagation of the first wave therethrough. In some such embodiments, each channel of the one or more second channels is configured to resonate at the target frequency, and the first channel is configured to not resonate at the target frequency.

In some embodiments, each of the one or more second channels is disposed, relative to the first channel, such that propagation of the second wave exiting the second outlet is capable of destructively interfering at the target frequency with the first wave exiting the first channel to reduce transmission of the first wave by at least 94 percent.

In some embodiments, each of the second channels is disposed, relative to the first channel, such that propagation of the second wave exiting the second outlet is capable of destructively interfering at the target frequency with the first wave exiting the first channel to dampen the first wave by at least 24 dB.

In some embodiments, the first channel has a first area (A1) in cross-section, and the one or more second channels define a second area in cross-section (A2), and the ratio of the first area (A1) to the sum of the first area (A1) and the second area (A2) [A1/(A1+A2)] is greater than 0.6.

Another embodiments of an apparatus comprises a first channel open to the propagation of a first wave at a target frequency therethrough, and having a first inlet, and a first outlet opening into an un-ducted volume, one or more second channels, each extending along an axis and open to the propagation of a second wave at the target frequency therethrough, each having a second inlet, and a second outlet opening into the un-ducted volume; wherein the one or more second channels is disposed, relative to the first channel, such that the second wave at the target frequency exiting the one or more second outlets is capable of destructively interfering with the first wave at the target frequency exiting the first channel.

In some such embodiments, each of the second channels is configured to resonate at the target frequency, and the first channel is configured to remain in a continuum state during propagation of the wave therethrough.

In some embodiments, each of the second channels is configured to resonate at the target frequency, and the first channel is configured to not resonate at the target frequency.

In some embodiments, wherein the first channel is open to a flow of fluid therethrough.

In some embodiments, wherein the first wave is a sound wave, the destructive interference dampens the sound wave at the target frequency.

In some embodiments, the first channel has a first area in cross-section, and the one or more second channels define a second area in cross-section, and first area in cross-section is larger than the second area in cross-section such that the apparatus has an openness ratio of at least 0.8.

In some embodiments, the first channel has a first area in cross-section, and the one or more second channels define a second area in cross-section, and first area in cross-section is larger than the second area in cross-section such that the apparatus has an openness ratio of at least 0.99.

Yet another embodiment of an apparatus comprises a first channel open to propagation of a first wave at a target frequency therethrough, and having a first inlet and a first outlet, wherein the first channel is configured to remain in a continuum state in the presence of a wave at the target frequency; one or more second channels, each open to propagation of a second wave at the target frequency therethrough and configured to resonate at the target frequency, and each having a second inlet and a second outlet; wherein each of the one or more second channels is disposed, relative to the first channel, such that the second wave at the target frequency exiting the one or more second outlets is capable of destructively interfering with the first wave at the target frequency exiting the first channel.

In some such apparatuses, the first channel is open to the flow of a fluid therethrough.

In some embodiments, the first channel is configured to not resonate at the target frequency.

In some embodiments, wherein the first wave is a sound wave, the destructive interference dampens the sound wave at the target frequency, to reduce transmission of the sound wave exiting the first channel by at least 94 percent.

In some embodiments, wherein the first wave is a sound wave, the destructive interference dampens the sound wave at the target frequency, to dampen the sound wave exiting the first channel by at least 24 dB.

In some embodiments, the first channel has a first area (A1) in cross-section, and the second channels define a second area in cross-section (A2), and the ratio of the first area (A1) to the sum of the first area (A1) and the second area (A2) [A1/(A1+A2)] is greater than 0.6.

In some embodiments, the first channel has a first area (A1) in cross-section, and the second channels define a second area in cross-section (A2), and the ratio of the first area (A1) to the sum of the first area (A1) and the second area (A2) [A1/(A1+A2)] is greater than 0.8.

In some embodiments, the first channel has a first area (A1) in cross-section, and the second channels define a second area in cross-section (A2), and the ratio of the first area (A1) to the sum of the first area (A1) and the second area (A2) [A1/(A1+A2)] is greater than 0.9.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing features of embodiments will be more readily understood by reference to the following detailed description, taken with reference to the accompanying drawings, in which:

FIG. 1A schematically illustrates a prior art exhaust silencer;

FIG. 1B schematically illustrates a prior art noise suppressor for a gas duct;

FIG. 1C schematically illustrates a prior art split path silencer;

DETAILED DESCRIPTION OF SPECIFIC EMBODIMENTS

Figure 2A:
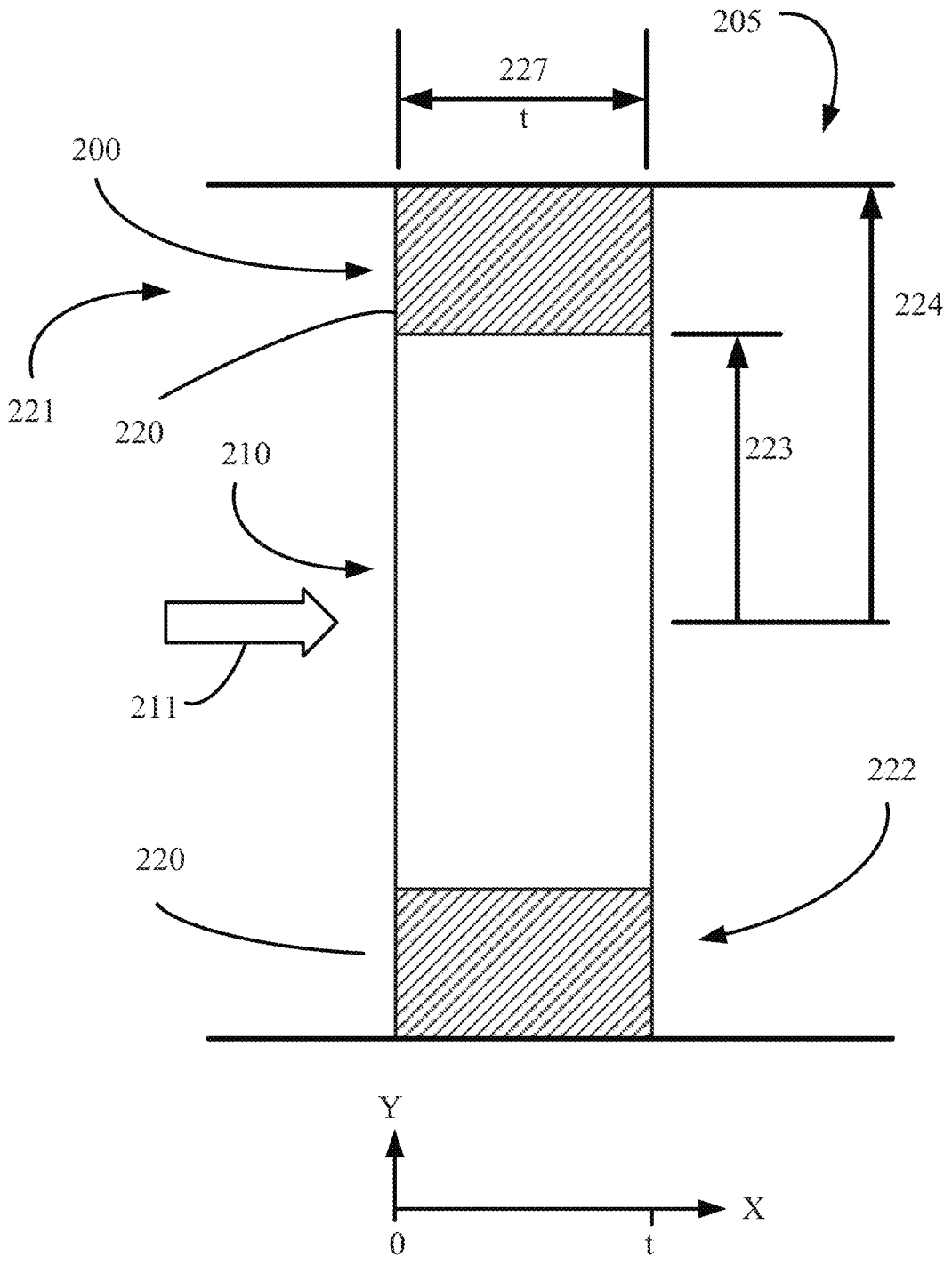
FIG. 2A schematically illustrates a cross-section view of an embodiment of a metamaterial sound silencer.

Various embodiments include an apparatus that allows substantial fluid flow (e.g., airflow) through the apparatus, while mitigating the propagation of noise through the apparatus, and while providing a form factor that is significantly more compact that known devices.

Moreover, embodiments allow a designer to specify and adjust one or both of the frequency or frequencies at which the apparatus mitigates noise propagation, and/or the bandwidth around the frequency or frequencies at which the apparatus mitigates noise propagation.

Definitions

The term "un-ducted" means a space downstream from a device is not bounded by a duct, e.g., which duct is an integral part of the device.

The term "acoustic wave" is a wave that propagates through a fluid by means of adiabatic compression and decompression.

The term "acoustic energy" means energy carried by, or propagated by, an acoustic wave.

The term "axial" means a direction parallel to an axis.

The term "axially oriented" means, with respect to an axis, oriented in a direction parallel to the axis.

The term "axis of fluid flow" means a direction in which fluid may flow.

The term "continuum state" means, with regard to a signal having a spectrum of frequencies, that the signal maintains energy in frequencies across that spectrum.

The term "destructive interference" or "destructively interfering" refers to the phenomenon in which two individual waves incident at a common point superpose to form a resultant wave having an amplitude equal to the difference in the individual amplitudes, respectively, of the individual waves.

The term "fluid" refers to any medium that is capable of flowing and though which a wave may propagate, including, but not limited to, a gas, a liquid, or combinations thereof.

The term "free space" (or "unbounded" space) in reference to a metamaterial silencer means space external to the metamaterial silencer, and external to a duct from which acoustic energy is received at the metamaterial silencer, or a duct on a downstream side of the metamaterial silencer.

The term "openness ratio" means, with respect to an apparatus having a first transmission region having a first area (A1), and having a second transmission region having a second area (A2), the ratio of the first area (A1) to the sum of the first area and the second area (A1+A2) [i.e., openness ratio=A1/(A1+A2)].

For the purposes of this disclosure and any claims appended hereto, "openness ratio" means, with respect to an apparatus having a first region cross-section area (A1), and a second region having a second cross-section area (A2), the ratio of the first cross-section area (A1) to the sum of the first and second cross-section areas (A1+A2) [i.e., openness ratio=A1/(A1+A2)].

The term "radial" means a direction perpendicular to an axis.

To "remain in a continuum state," with regard to a channel though which a signal propagates, means that the channel is configured to pass the signal while maintaining the signal's continuum state. In contrast, a channel that resonates at a frequency within the signal's spectrum would not maintain the signal in the signal's continuum state.

A "set" includes at least one member. For example, a set of channels includes at least one channel.

A "target frequency" is a frequency of acoustic energy for which a bilateral metamaterial silencer tuned or configured to produce destructive interference.

The term "transmittance" means, with regard to the energy of a signal incident on an apparatus, the ratio of the energy that passes through the apparatus to the energy incident on the apparatus.

Some embodiments below are illustrated using gas as the fluid medium in which a signal propagates, and as the fluid medium that flows through the metamaterial silencer. Embodiments are not limited to gas as the fluid medium, however, because that fluid medium may also be a liquid. Consequently, illustrative embodiments described in terms of such gas do not limit such embodiments.

Figure 2B:
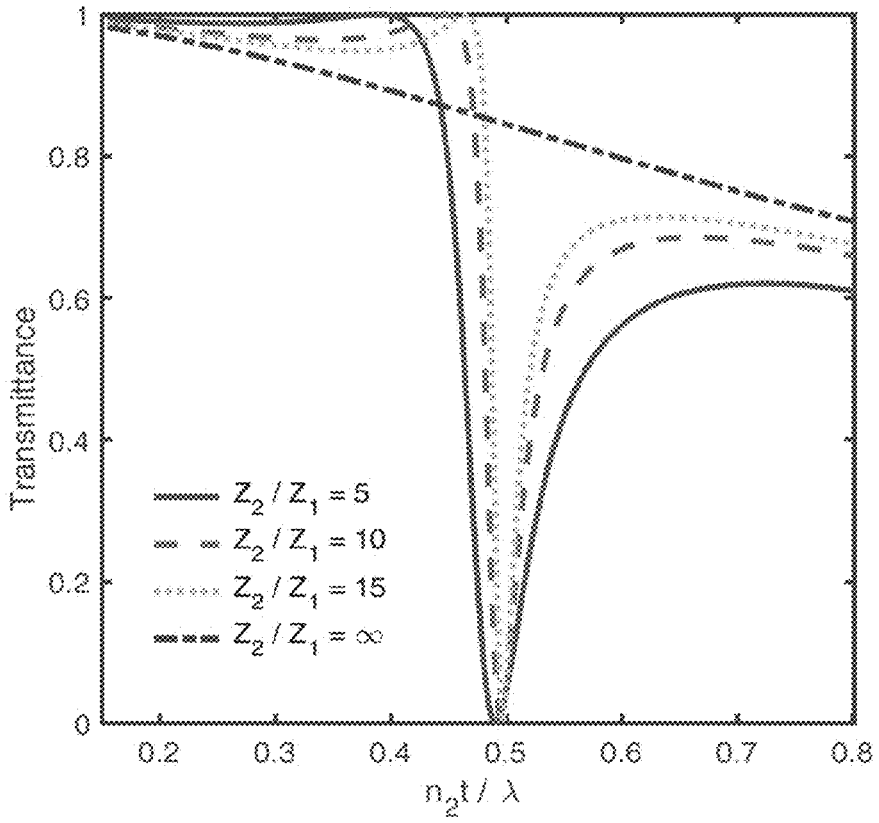
FIG. 2B is a graph illustrating transmission of acoustic energy through the metamaterial silencer 100 at various ratios of impedance.
Figure 2C:
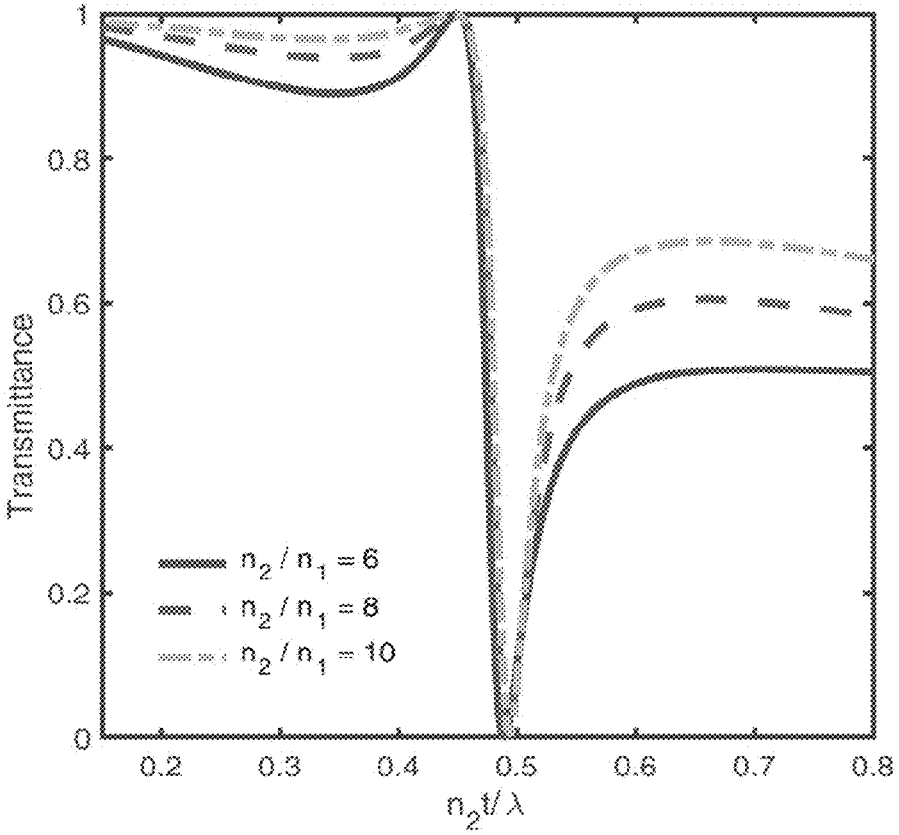
FIG. 2C is a graph illustrating transmission of acoustic energy through the metamaterial silencer 100 at various ratios of refractive index.

FIG. 2A, FIG. 2B, FIG. 2C: A Transverse Bi-Layer Metamaterial Silencer FIG. 2A schematically illustrates a cross-section view of an embodiment of a metamaterial sound silencer 200.

The metamaterial sound silencer 200 has a first transmission region 210 that defines an aperture that is open to permit gas flow through the metamaterial silencer 200.

To that end, the first transmission region 210 is open, such that a solid object, such as a straight, rigid rod for example, could pass through the first transmission region 210 without bending, and without hitting the metamaterial silencer 200. For example, the first transmission region 210 may have the shape of a hollow cylinder, defined by an inner ring 302 having an inner radial face 325 and a thickness 227 ("t") (in this embodiment, the thickness may be thought of as the cylinder height). In illustrative embodiments, the thickness 227 is also the cylinder height and is therefore the length of the first channel 210. In illustrative embodiments, the thickness 227 of the apparatus 200 is less than one-quarter of the wavelength of the target frequency, and in some embodiments the thickness 227 is less than is less than one-eighth of the wavelength of the target frequency, and in some embodiments the thickness 227 is less than one-sixteenth of the wavelength of the target frequency. In preferred embodiments, the channels 210, 220 are shorter than one-half of the wavelength of the target frequency.

In the embodiment of FIG. 2A, the first transmission region 210 defines a fluid flow axis 211 along which fluid (e.g., gas and/or liquid) may flow through the first transmission region 210, and therefore through the metamaterial silencer 200.

The first transmission region 210, when in a gaseous environment, has a first acoustic impedance (Z1) and a first acoustic refractive index (n1). In contrast to the second transmission region 220, the first transmission region 210 is configured (e.g., due to its dimensions) not to resonate at the target frequency.

The metamaterial sound silencer 200 has a second transmission region 220. In general, the second transmission region 220 includes a set of one or more conduits, each conduit in the set configured to resonate at a target frequency. The second transmission region 220 has an inlet and an outlet, such that a wave may propagate through the second transmission region 220 from its inlet to its outlet. In illustrative embodiments, a fluid may flow through the second transmission region 220 from its inlet to its outlet.

Several noteworthy properties of the metamaterial silencer 200 are described below.

Openness

The first transmission region 210 has a first region area ("A1") facing the impinging acoustic signal, and the second transmission region 220 has a second region area ("A2") facing the impinging acoustic signal.

The ratio (A1/A1+A2) of the area (A1) of the first transmission region 210 to the sum of that area plus the area (A2) of the second transmission region 220 may be considered as a metric of the openness, to fluid flow, of the metamaterial silencer 200. This ratio may be referred to as an "openness" ratio, and may be expressed, for example, as a fraction or a percentage of the apparatus that is open to fluid flow. Illustrative embodiments described herein enable the metamaterial silencer 200 to have an openness ratio of at least 0.6 (or 60%), or more. For example, some embodiments have an openness ratio of 0.7 (70%), 0.8 (80%), 0.9 (90%), or greater, for example up to 0.99 (99%), all while maintaining its ability to dampen a signal. Such metamaterial silencers may be referred to as an "ultra-open metamaterial" ("UOM"), and are in marked contrast to prior art devices, which could have openness ratios not exceeding 40%, for example.

Impedance and Refractive Index

Also, as explained in more detail below, when the metamaterial silencer 200 is disposed in a fluid (e.g., gaseous) environment, the first transmission region 210 has a first acoustic impedance (which may be referred to as "Z1") and a first acoustic refractive index (which may be referred to as "n1"), and the second transmission region 220 has a second acoustic impedance (which may be referred to as "Z2") and a second acoustic refractive index (which may be referred to as "n2"). The first acoustic impedance (Z1), the first acoustic refractive index (n1), the second acoustic impedance (Z2), and the second acoustic refractive index (n2) are determined at least in part by the physical dimensions of the metamaterial silencer 200.

Transmittance

Transmittance is a quantitative measure of the transmission of wave energy (e.g., acoustic energy) of an impinging signal through the metamaterial silencer 200 from the upstream side 221 to the downstream side 222. For example, transmittance may be specified as a ratio of the energy transmitted from the metamaterial silencer 200 (e.g., output from the downstream side 222 of the metamaterial silencer 200) to the energy received by the metamaterial silencer 200 (e.g., input to the first transmission region 210). In other words, acoustic transmittance is ratio of the transmitted energy to the incident energy. For example, if a signal impinges a metamaterial silencer 200 with a given amount of energy, and the energy transmitted from the metamaterial silencer 200 is only 6 percent (6%) of the energy received into the first transmission region 210, then the ratio of 6/100, or 0.06. Stated alternately, the metamaterial silencer 200 has dampened the signal by 94%, or 24.4 dB, where dB is calculated as 20 log (input energy/output energy). In this example, the ratio of input energy to output energy is 100/6=16.66, and 20 log (16.66)=24.4 dB.

The examples in FIGS. 2B and 2C are based on an acoustic plane wave incident on the upstream side 221 of the metamaterial silencer 200 with distinct acoustic properties.

It is assumed for these examples that the metamaterial silencer 200 has an axisymmetric configuration with respect to the X-axis with the thickness of t in which the first transmission region 210 (r<223) has an acoustic impedance of $Z_1$ and refractive index of $n_1$, and the second transmission region 220 (223<r<224) has an acoustic impedance of Z2 and refractive index of $n_2$. Note that the axisymmetric configuration is selected solely for the purpose of simplification and other configurations such as rectangular prism of honeycomb-like shape may be considered without a loss of generality. As described above, the interface between the first transmission region 210 and the second transmission region 220 (r=223) is considered as a hard boundary and the entire structure is assumed to be confined within a rigid, cylindrical (i.e., circular in cross-section) waveguide filled with a medium with sound speed of Co and density of $p_0$, for the purposes of deriving the acoustic transmittance.

As the first step to derive the transmittance, the following definitions of acoustic pressure and velocity field at the interfaces (x=0 and x=t) are employed to relieve the transverse variation of the fields.

$$\overline{P}_1(x=0)=\frac{2\pi}{\pi r_1^2}\int_0^{r_1} p(r,x)\Big|_{x=0} rdr$$

$$\overline{P}_2(x=0)=\frac{2\pi}{\pi(r_2^2-r_1^2)}\int_{r_1}^{r_2} p(r,x)\Big|_{x=0} rdr$$

$$\overline{P}_1(x=t)=\frac{2\pi}{\pi r_1^2}\int_0^{r_1} p(r,x)\Big|_{x=t} rdr$$

$$\overline{P}_2(x=t)=\frac{2\pi}{\pi(r_2^2-r_1^2)}\int_{r_1}^{r_2} p(r,x)\Big|_{x=t} rdr$$

-continued $$\overline{U}_1(x=0)=2\pi\int_0^{r_1}u(r,x)\Big|_{x=0}rdr$$

$$\overline{U}_2(x=0)=2\pi\int_{r_1}^{r_2}u(r,x)\Big|_{x=0}rdr$$

$$\overline{U}_1(x=t)=2\pi\int_0^{r_1}u(r,x)\Big|_{x=t}rdr$$

$$\overline{U}_2(x=t)=2\pi\int_{r_1}^{r_2}u(r,x)\Big|_{x=t}rdr$$

In which p and u are acoustic pressure and velocity field, respectively. $P_{1,2}$ and $U_{1,2}$ are averaged pressure and volume velocity at the first transmission region 210 and the second transmission region 220 interfaces. Next, considering that the regions are separated with a hard boundary, the transfer matrices relating the output pressure and velocity to the input condition, for first transmission region 210 and second transmission region 220, may be written in a decoupled fashion.

$$\begin{bmatrix}\overline{P}_1(x=t)\\ \overline{U}_1(x=t)\end{bmatrix}=\begin{bmatrix}\cos(k_0n_1t) & iZ_1\sin(k_0n_1t)\\ \frac{i}{Z_1}\sin(k_0n_1t) & \cos(k_0n_1t)\end{bmatrix}\begin{bmatrix}\overline{P}_1(x=0)\\ \overline{U}_1(x=0)\end{bmatrix}$$

$$\begin{bmatrix}\overline{P}_2(x=t)\\ \overline{U}_2(x=t)\end{bmatrix}=\begin{bmatrix}\cos(k_0n_2t) & iZ_2\sin(k_0n_2t)\\ \frac{i}{Z_2}\sin(k_0n_2t) & \cos(k_0n_2t)\end{bmatrix}\begin{bmatrix}\overline{P}_2(x=0)\\ \overline{U}_2(x=0)\end{bmatrix}$$

In which ko is the wave number associated with the medium within the duct, defined as ω/Co, n1 and n2 are the refractive indices of transmission regions 210 and 220, respectively, t is the thickness, and $Z_1$ and $Z_2$ are the characteristic impedance values transmission regions 210 and 220, respectively. Applying Green's function method, one may derive the following relationships.

$$\overline{P}_1(x=0)=2+4ik_0\frac{\rho_0c_0}{r_1^4}U_1(x=0)\int_0^{r_1}\int_0^{r_1}G_1(r,0,r_0,0)r_0dr_0rdr+$$

$$4ik_0\frac{\rho_0c_0}{r_1^2(r_2^2-r_1^2)}U_2(x=0)\int_0^{r_1}\int_{r_1}^{r_2}G_1(r,0,r_0,0)r_0dr_0rdr$$

$$\overline{P}_2(x=0)=2+4ik\frac{\rho_0c_0}{r_1^2(r_2^2-r_1^2)}U_1(x=0)\int_{r_1}^{r_1}\int_0^{r_1}G_1(r,0,r_0,0)r_0dr_0rdr+$$

$$4ik\frac{\rho_0c_0}{(r_2^2-r_1^2)^2}U_2(x=0)\int_{r_1}^{r_2}\int_{r_1}^{r_2}G_1(r,0,r_0,0)r_0dr_0rdr$$

$$\overline{P}_1(x=t)=-4ik\frac{\rho_0c_0}{r_1^4}U_1(x=t)\int_0^{r_1}\int_0^{r_1}G_2(r,t,r_0,t)r_0dr_0rdr-$$

-continued $$4ik\frac{\rho_0c_0}{r_1^2(r_2^2-r_1^2)}U_2(x=t)\int_0^{r_1}\int_{r_1}^{r_2}G_2(r,t,r_0,t)r_0dr_0rdr$$

$$\overline{P}_2(x=t)=-4ik\frac{\rho_0c_0}{r_1^2(r_2^2-r_1^2)}U_1(x=t)\int_{r_1}^{r_1}\int_0^{r_1}G_2(r,t,r_0,t)r_0dr_0rdr-$$

$$4ik\frac{\rho_0c_0}{(r_2^2-r_1^2)^2}U_2(x=t)\int_{r_1}^{r_2}\int_{r_1}^{r_2}G_2(r,t,r_0,t)r_0dr_0rdr$$

In which Green's functions are defined as:

$$G_1(r,x,r_0,x_0)=\sum_{n=0}^{n=\infty}\frac{\varphi_n(r_0)\varphi_n(r)}{-2i\pi r_2^2\sqrt{k^2-k_n^2}}\left(e^{i\sqrt{k^2-k_n^2}\,|x-x_0|}+e^{i\sqrt{k^2-k_n^2}\,|x+x_0|}\right)$$

$$G_2(r,x,r_0,x_0)=\sum_{n=0}^{n=\infty}\frac{\varphi_n(r_0)\varphi_n(r)}{-2i\pi r_2^2\sqrt{k^2-k_n^2}}\left(e^{i\sqrt{k^2-k_n^2}\,|x-x_0|}+e^{i\sqrt{k^2-k_n^2}\,|x+x_0-2t|}\right)$$

Where the eigenmodes are defined as $\varphi_n(r)=J_0(k_nr)/J_0(k_nr_2)$ with the wavenumber $k_n$ as the solution of $J'(k_nr_2)=0$.

By solving the foregoing equations, one may readily calculate the averaged pressures and volume velocities defined above, from which the acoustic transmittance may readily be derived as:

$$T=\tfrac{1}{4}(M_{11}+M_{12}/\rho_0c_0+\rho_0c_0M_{21}+M_{22})$$

When:

$$\begin{bmatrix}P(x=t)\\ u(x=t)\end{bmatrix}=\begin{bmatrix}M_{11} & M_{12}\\ M_{21} & M_{22}\end{bmatrix}\begin{bmatrix}P(x=0)\\ u(x=0)\end{bmatrix}$$

$$P(x=0)=\frac{1}{\pi r_2^2}(\pi r_1^2\overline{P}_1(x=0)+\pi(r_2^2-r_1^2)\overline{P}_2(x=0))$$

$$u(x=0)=\frac{1}{\pi r_2^2}(\overline{U}_1(x=0)+\overline{U}_2(x=0))$$

$$P(x=t)=\frac{1}{\pi r_2^2}(\pi r_1^2\overline{P}_1(x=t)+\pi(r_2^2-r_1^2)\overline{P}_2(x=t))$$

$$u(x=t)=\frac{1}{\pi r_2^2}(\overline{U}_1(x=t)+\overline{U}_2(x=t))$$

The transmittance from the bilayer metamaterial silencer 200 for different values of refractive index and acoustic impedance are illustrated in the graphs in FIG. 2B and FIG. 2C. In FIG. 2B, the effect of characteristic impedance ratio is depicted, for which the Q-factor (i.e., the "quality factor") of filtration may be tuned. In FIG. 2C, the effect of refractive index ratio is demonstrated for which filtration frequency regime can be adjusted.

In FIG. 2B, it is considered that n2/n1=10 and the transmittance is depicted versus the non-dimensional quantity n2t/A (A denotes the wavelength) for four different values of the impedance ratio. In FIG. 2C, the impedance ratio has been kept constant (Z2/Z1=10) and the transmittance is depicted for three different values of the refractive index ratio. Notably, for these examples, the background medium within the waveguide is considered air and it is assumed that the medium in transmission first transmission region 210 is identical to the background medium. Hence, the characteristic acoustic impedance of transmission first transmission region 210 may be derived as $Z_i=\rho_0 c_0/\pi r_1^2$ and the refractive index (n1) is equal to unity.

From FIG. 2B and FIG. 2C, it may be observed that for different values of $Z_2$ and n2, given the differing acoustic properties of transmission region 210 transmission region 220, an asymmetric transmission profile is obtained in which destructive interference may result in zero transmittance due to Fano-like interference. The destructive interference emerges where $n2t \approx \lambda/2$ which is the resonating state of the second transmission region 220. Given the contrast in refractive indices (n1 and n2) of the two regions, the first transmission region 210 will remain in a continuum state and, consequently, a Fano-like interference occurs. During this state, the portion of the acoustic wave traveling through the second transmission region 220 interacts with resonance-induced localized modes in this region, resulting in an out-of-phase condition after traveling through this region. The portion of the incident acoustic wave traveling through region 210 will pass the metamaterial 200 with negligible phase shift and, consequently, a resultant destructive interference occurs on the transmission side of the metamaterial. Of note, the destructive interference initially occurs at $n2t \approx \lambda/2$ which is the first resonance mode of region 220, but will also occur at higher resonance modes when $n2t \approx N\lambda/2$ for integers of N.

From FIG. 2B, by comparing the transmittance for different values of the impedance ratio, it can be understood that by increasing the contrast between the characteristic acoustic impedances of the two regions, the quality factor (Q factor) of the attenuation performance is increased. This attribute provides a degree of freedom and, by adjusting the impedance contrast, the desired filtration bandwidth may be realized. Of interest, when the characteristic impedance ratio yields a very large number ($Z_2/Z_1=\infty$), the filtration performance is suppressed, given its marked narrowband character, and an orifice-like behavior is realized. However, the orifice structure with a similar open area geometry results in a relatively poor sound filtration performance, leading to only minor reductions in attenuation of the transmitted acoustic wave.

FIG. 2C demonstrates the effect of refractive index contrast between the two media on transmittance and illustrating that high degrees of filtration are obtained when $n2t \approx \lambda/2$. Thusly, the inventors have discovered that by adjusting the refractive indices in the proposed structure, high performance sound attenuation may be realized at any desired frequency.

As shown in FIG. 2B and FIG. 2C, the transmittance of the acoustic signal, at the target frequency is at or near zero. Thus it may be said that the destructive interference dampens sound wave at the target frequency, to reduce transmission of the sound wave silencer 200 by at least 94%.

It should be noted that the metamaterial silencer 200 is a passive device in that it does not require a supply of energy, and instead operates using only the energy in an impinging signal.

From the foregoing disclosure, and in view of examples provided below, it can be understood that the properties of a metamaterial silencer 200 can be specified by selection of its parameters, such as physical dimensions (radiuses, thickness, helix angle) and other properties (Z1, Z2, n1, n2). For example, by informed selection of such parameters, a designer can specify the target frequency of a metamaterial silencer 200 (the frequency at which its dampening effect is most pronounced), its bandwidth at that target frequency, and its openness ratio. Moreover, by specification of physical dimensions, the first transmission region 210 of a metamaterial silencer 200 may be configured such that a wave propagating through that first transmission region 210 remains in a continuum state (e.g., the first transmission region does not resonate at the target frequency) (such a first transmission region may be described as maintaining, or remaining in, a continuum state), and the second transmission region 220 may be configured such that it resonates at the target frequency.

FIG. 3A-3D: A Cylindrical Embodiment of a Metamaterial Silencer

Figure 3A:
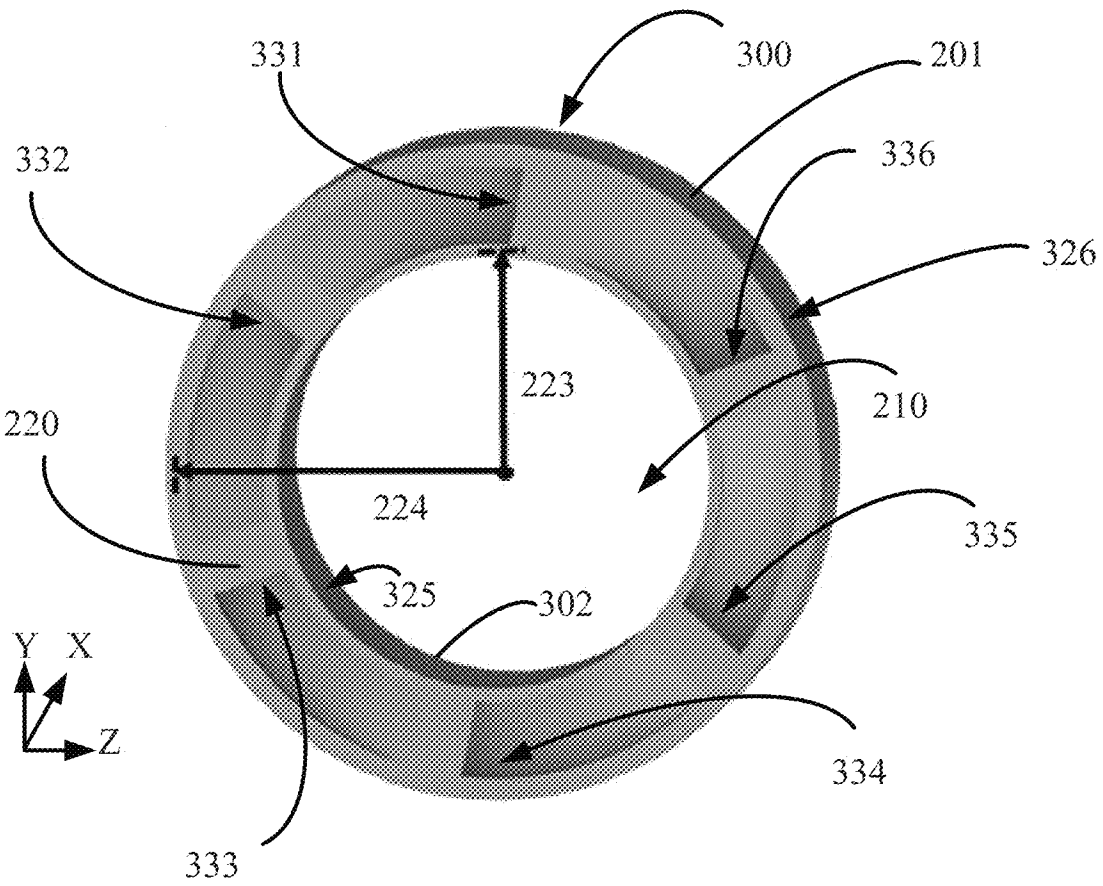
FIG. 3A schematically illustrates a view of an embodiment of a metamaterial sound silencer.
Figure 3B:
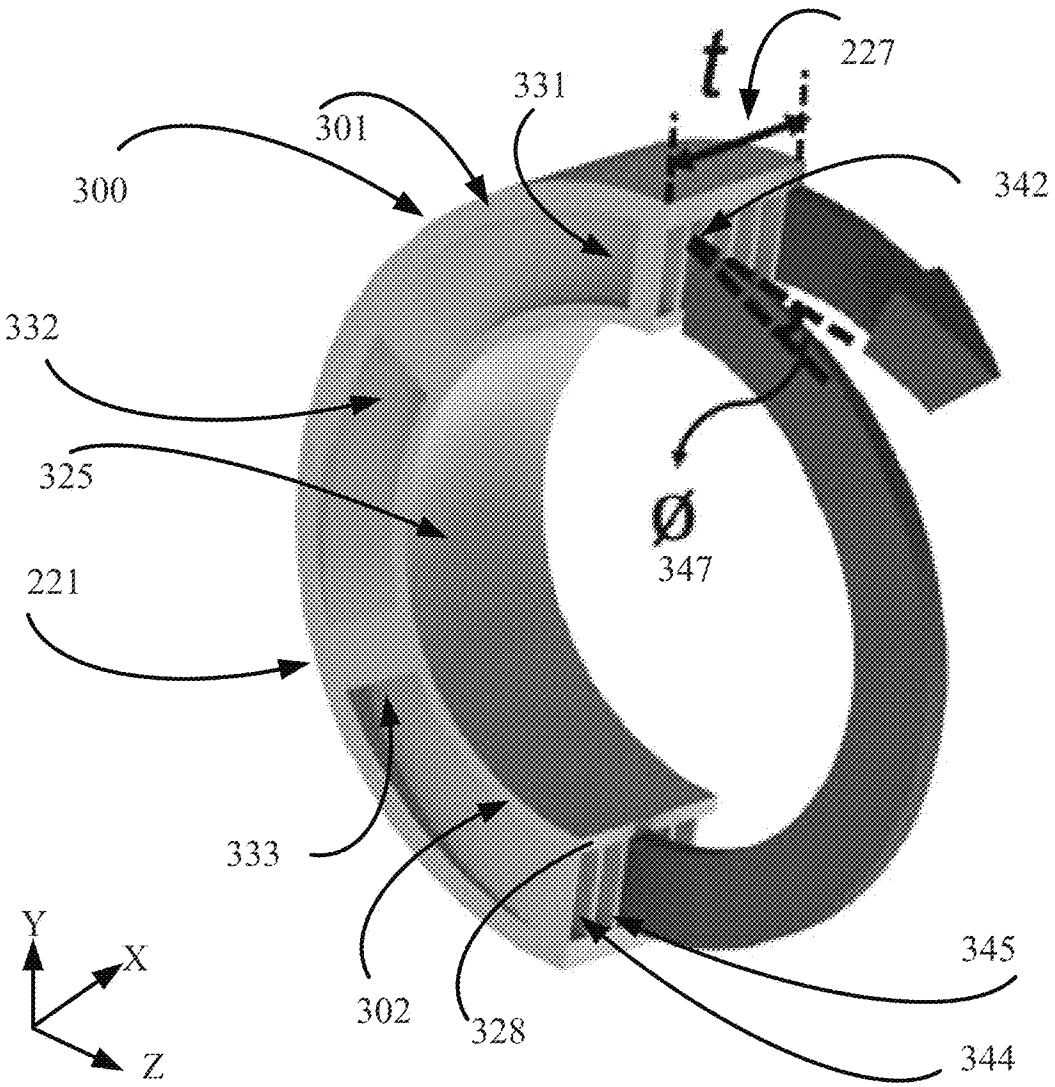
FIG. 3B schematically illustrates another view of an embodiment of a metamaterial sound silencer.
Figure 3C:
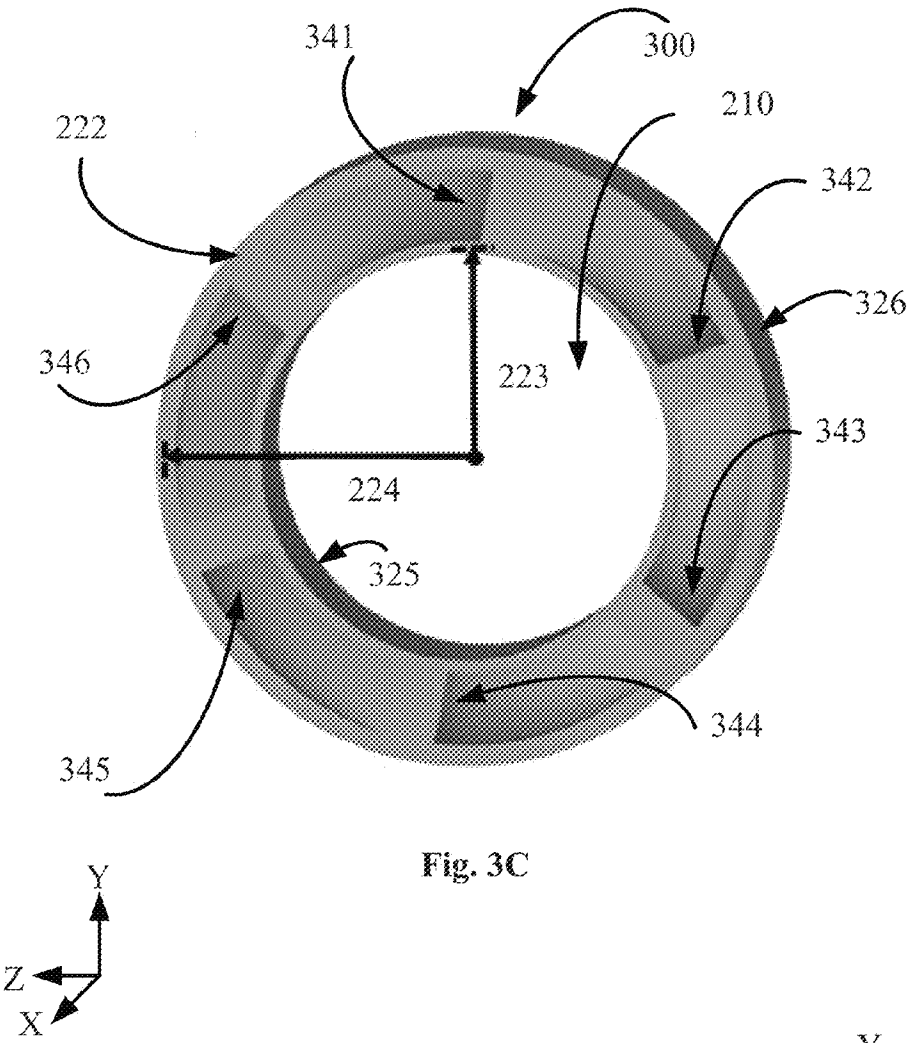
FIG. 3C schematically illustrates another view of an embodiment of a metamaterial sound silencer.
Figure 3D:
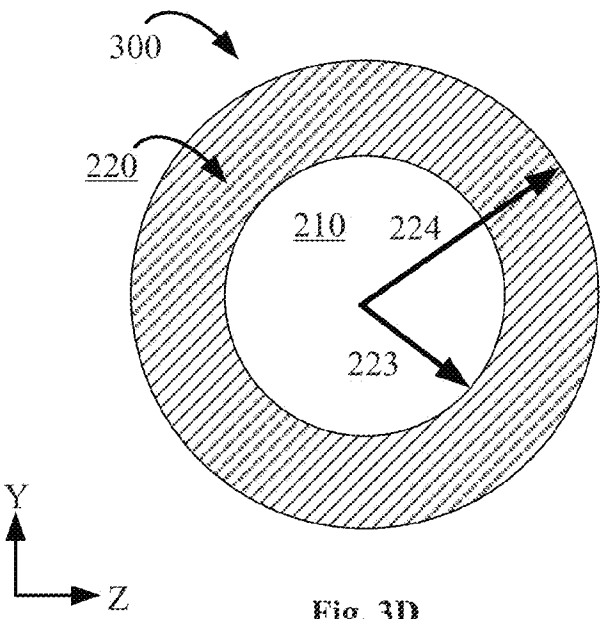
FIG. 3D schematically illustrates a cross-section view of the embodiment of FIG. 3A.

FIG. 3A schematically illustrates a front view of an embodiment (300) of a cylindrical bilayer metamaterial silencer 200. FIG. 3B schematically illustrates a side cutaway view of the cylindrical bilayer metamaterial silencer 300, and FIG. 3C schematically illustrates a rear view of the cylindrical bilayer metamaterial silencer 300.

The metamaterial silencer 300 in FIG. 3A has a cylindrical shape, and includes an outer ring 301 with an outer surface 326. The outer ring 301 defines an interior space that includes the two transmission regions (or "layers") 210 and 220.

The first transmission region 210 in this embodiment includes an inner ring 302, and is defined by an inner radius 223.

In preferred embodiments, the inner ring 302 acoustically isolates the first transmission region 210 from the second transmission region 220 by substantially preventing the transmission of gas and acoustic energy from a gas within the first transmission region 210 to the second transmission region 220, and by substantially preventing the transmission of gas and acoustic energy from a gas within the second transmission region 220 to the first transmission region 210. The inner ring 302 may be referred to as an "acoustically rigid spacer." In illustrative embodiments, the inner ring 302 is made of acrylonitrile butadiene styrene plastic.

The second transmission region 220 in this embodiment is defined by the outer radius 224 and the inner radius 223. As shown in FIG. 3A and FIG. 3C, the second transmission region 220 has an upstream face 221 on a first side, and a downstream face 222 on the side opposite the first side.

The second transmission region 220 includes a set of helical channels 341, 342, 343, 344, 346. Each helical channel 341-346 of the set of helical channels has a corresponding channel inlet aperture (331-336, respectively) opening to the upstream face 221, and a corresponding channel outlet aperture (351-356, respectively) opening to the downstream face 222.

The upstream face 221 of the first transmission region 210 has an area (A1) defined as the square of the inner radius 223 times pi. As shown, the second transmission region 220 includes a set of helical channels 341-346. Each of those helical channels 341-346 has a radial height defined as the distance between the inner ring 302 and the outer ring 301 (or the inner radius 223 and the outer radius 224). Consequently, when viewed in cross-section (FIG. 3D, along the X axis of FIG. 3A), the set of channels presents a cross-section having an area (A2) of two pi time the square of the difference between the inner radius 223 and the outer radius 224. In other words, the second transmission region 220 of the metamaterial silencer 300 of FIG. 3A is annular in shape, and has an area of two pi times the square of outer radius (224) minus two pi times the square of the inner radius (223) [i.e., $2\pi(R_2^2-R_1^2)$, where $R_1$ is the inner radius 223 and $R_2$ is the outer radius 224)]. In fact, the second transmission region 220 would have the same area (A2) even if the metamaterial silencer 300 of FIG. 3A had only a single helical channel (e.g., 341) because even that single helical channel would, when viewed in cross-section, present a cross-section having an area (A2) of two pi time the square of the difference between the inner radius 223 and the outer radius 224.

The helical channels 341-346 may be referred to as "resonator channels" because, in operation, one or more frequency components (each a "target frequency") of an acoustic wave impinging on the upstream face 221 will resonate in one or more of the helical channels 341-346.

Each helical channel 341-346 of the set of helical channels has a helical axis, and in illustrative embodiments the helical channels 341-346 have the same helical axis.

Each helical channel 341-346 of the set of helical channels has a helix angle 347. In the embodiment of FIG. 3A, each the helix angle 347 for each helical channel 341-346 is the same, but in some embodiments, any one or more of the helical channels 341-346 may have a helix angle 347 that is different from the helix angle 347 of one or more of the other helical channels in the set.

Each helical channel 341-346 of the set of helical channels also has a channel length, the length of a given helix channel being the distance, along the helix axis, between its corresponding channel inlet aperture and corresponding channel outlet aperture. In illustrative embodiments, each helical channel 341-346 of the set of helical channels is a sub-wavelength structure, in that its channel length is less that the wavelength of the frequency for which the channel acts as a silencer. Moreover, in some illustrative embodiments, the channel length of each channel 331-336 is one half (½) of the wavelength of the frequency for which the channel acts as a silencer, and in preferred embodiments is less than one half (½) (but more than ¼) of such a wavelength.

The operation, and certain characteristics, of a bilateral metamaterial silencer 300 configured to have a target frequency of 460 Hz, are described below, with the understanding that the operation and characteristics of a metamaterial silencer 200 generally are not limited to that specific embodiment. The embodiment of the metamaterial silencer 300 used to produce these characteristics had a thickness (t) 327 of 5.2 cm; an inner radius 223 of 5.1 cm, and outer radius 224 of 7 cm, and a helix angle 347 of 8.2 degrees. The impedance ratio Z2/Z1 was 7.5, and the refractive index ratio n2/n1 was 7.

FIGS. 4A-4D: Metamaterial Silencer Performance

In illustrative embodiments of operation, a metamaterial silencer 300 is disposed in the path of an acoustic signal propagating in a gas. Specifically, the metamaterial silencer 300 is disposed such that the acoustic signal impinges on, and enters, the first transmission region 210 and the second transmission region 220 (in this example, the channel inlet apertures 331-336 of the helical channels 341-346). A portion of the wave propagating in the first transmission region 210 may be referred-to as a first wave, and the portion of the signal propagating in the second transmission region 220 may be referred to as a second wave. It should be noted that acoustic energy from the acoustic signal may enter the channel inlet apertures 331-336 without first entering the cylinder of the first transmission region 210.

The gas itself may be moving in a direction along the gas flow axis 211. Such a direction may be referred to as the "downstream" direction. The acoustic signal may have a spectrum that includes a plurality of frequency components. In illustrative embodiments, the metamaterial silencer 300 is configured to allow the gas to pass through the first transmission region 210, while dampening or silencing at least one frequency (the "target frequency) of the acoustic signal spectrum.

As previously noted, the helical channels 341-346 may be referred to as "resonator channels" because, in operation, one or more frequency components of the acoustic wave impinging on the upstream face 221 resonates in one or more of the helical channels 341-346. Simultaneously, the acoustic signal propagates through the first transmission region 210 without resonating (i.e., in a "continuum state"). Moreover, if the gas is moving, it may pass through the first transmission region 210 substantially unimpeded.

Acoustic energy from the helical channels 341-346 exits the metamaterial silencer 300 at the channel outlet apertures 351-356. Specifically, the acoustic energy exits from the downstream face 222 of the metamaterial silencer 300 into the unbounded space 205 disposed in the downstream direction from the metamaterial silencer 300. Moreover, in illustrative embodiments, the acoustic energy exits from the second channel 220 of the metamaterial silencer 300 in a tangential direction. The tangential direction is defined as a direction tangential to a radius (223, 224) extending from a center of the metamaterial device 300, and substantially parallel to downstream face 222. The direction of energy exit from the second channel 220 of the metamaterial silencer 300 may still be described as axial (or axially-oriented), however, at least in that it is not in a radial direction.

The acoustic energy from each helical channel 341-346 has a frequency equal to the resonant frequency of the channel from which it exits, and through FANO interference, cancels acoustic energy at that frequency in the gas from the first transmission region 210.

Figures 4A, 4B:
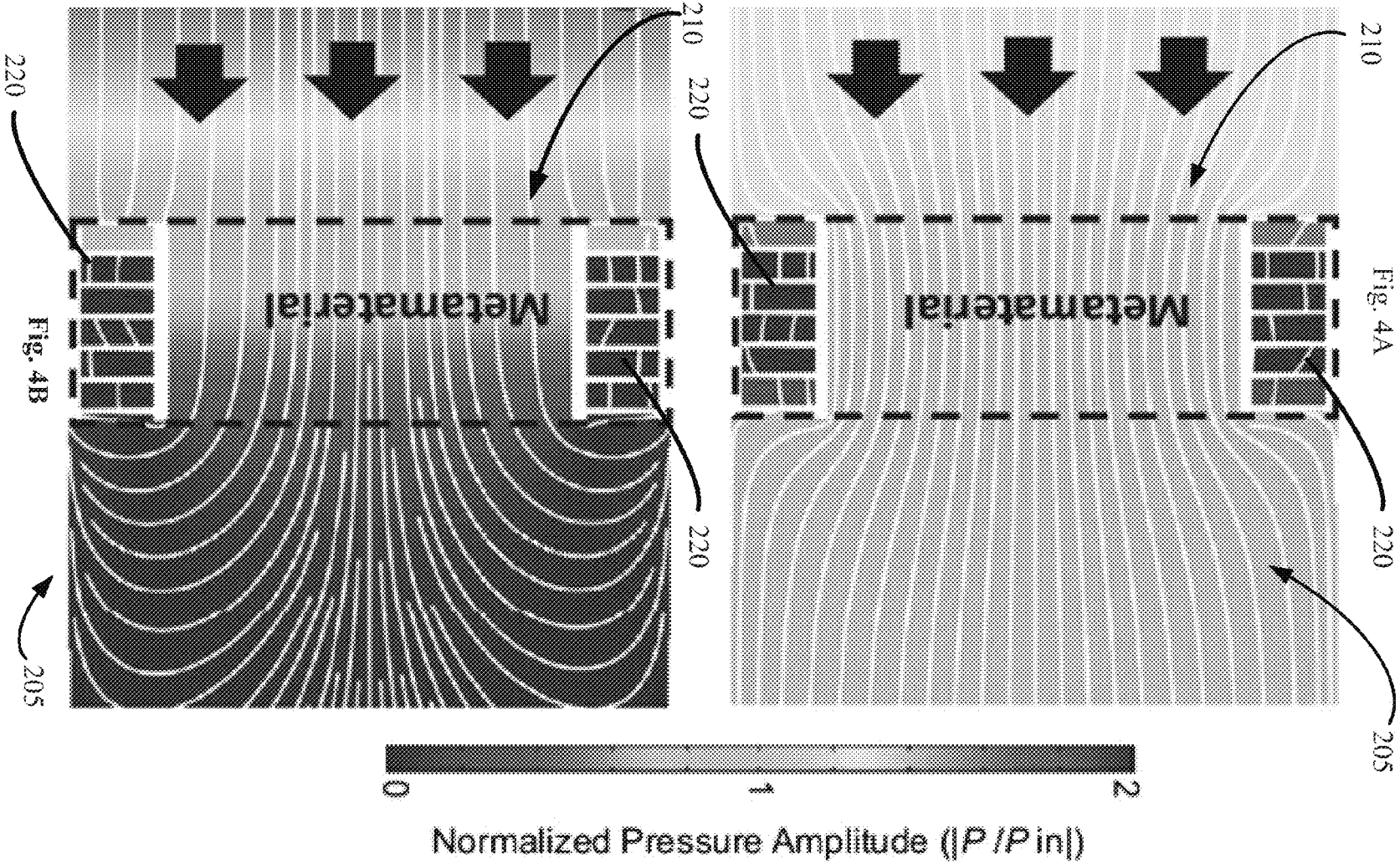
FIG. 4A is a graphic illustrating transmission of acoustic energy through the metamaterial silencer 100 at a non-target frequency.
FIG. 4B is a graphic illustrating transmission of acoustic energy through the metamaterial silencer 100 at a target frequency.

In order to visualize the silencing performance of an embodiment of a metamaterial silencer 300, FIG. 4A and FIG. 4B schematically illustrate sound transmission through the metamaterial silencer 300. FIG. 4A and FIG. 4B show cutaway views of the metamaterial silencer 300. In other words, in these figures, a cut plane is used to demonstrate the resultant pressure and velocity fields in two dimensions (2D).

FIG. 4A is a graph illustrating transmission of a first frequency of a plane wave incident on a bilateral metamaterial silencer. FIG. 4B is a graph illustrating transmission of a second frequency (a "target" frequency) of a plane wave incident on a bilateral metamaterial silencer. In FIG. 4A and FIG. 4B, the background color represents the absolute value of the pressure field normalized by the amplitude of the incident wave, and the white lines reflect the stream and orientation of the local velocity field.

Demonstrated in FIG. 4A is a plane wave with frequency of 400 Hz incident on the metamaterial silencer 300 from the left side as shown with black arrows. In accordance with the analytically and experimentally expected behaviors of the metamaterial silencer 300 structure, in the frequency regime of 400 Hz, high-pressure transmission results.

At this state, given the fact that the helical portion 220 of the metamaterial silencer 300 structure possesses a markedly larger acoustic impedance (Z2) in comparison with the acoustic impedance (Z1) of the open portion 210 in the center, the incident wave will predominately travel through the central open portion 210 of the metamaterial silencer 300. This behavior may be visually confirmed with the local velocity field stream shown in FIG. 4A where both preceding and beyond the metamaterial silencer 300 structure, the velocity field exhibits minimal disturbance save for the change in cross-sectional area.

In FIG. 4B, a similar case of a plane wave incident from the left side is demonstrated but with a frequency of 460 Hz. Based on the theoretical and experimental results obtained above, it is expected that at this frequency, the wave transmitted through the helical portion 220 of the metamaterial silencer 300 will become out of phase with the transmitted wave traveling through the central open portion 210 of the metamaterial silencer 300. The results obtained herein demonstrate that the destructive interference on the transmission side (right side in these figures) of the metamaterial silencer 300 has resulted in dampening wave transmission in the unbounded space 205.

Notably, the out-of-phase transmission through the two regions 210, 220 of the metamaterial silencer 300 may be further understood by reference to the velocity profile shown in FIG. 4B with white lines. It may be readily observed that the local acoustic velocities of the transmitted wave from the two regions 210, 220 of the metamaterial silencer 300 are in opposite directions, resulting in a marked curvature of the velocity stream and diminished far-field radiation. It should be mentioned that, with the presence of the destructive interference due to Fano-like interference, the metamaterial structure 300 mimics the case of an open-end acoustic termination in which near-zero effective acoustic impedance results in a predominant reflection of the incident wave.

In other words, in FIG. 4A, the absolute pressure value normalized by the incident wave magnitude resulting from a plane wave with a frequency of 400 Hz and incident on the metamaterial silencer 300 from the left-hand side is shown using a color map. The local velocity stream is shown with the white lines. At this frequency, the transmission coefficient (which is the ratio of the transmitted pressure over incident pressure) is about 0.85, hence, approximately 72% of the acoustic wave energy is transmitted.

In FIG. 4B, the pressure and velocity profile is depicted with an incident plane wave of the same amplitude as the incident wave described in FIG. 4A, but having a frequency of 460 Hz. At this frequency, due to Fano-like interference, the transmitted wave has a markedly decreased amplitude, and the wave has been effectively silenced. In this embodiment, the phase difference between the transmitted waves from the two regions 210, 220 of the metamaterial silencer 300 has resulted in a curvature of the wave velocity field and has diminished the far-field radiation.

Figure 4C:
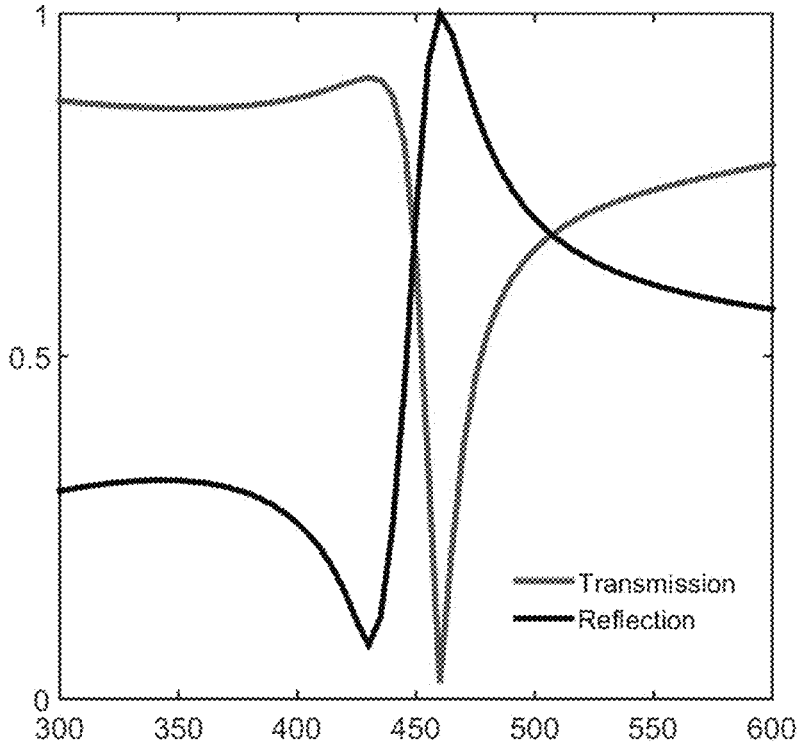
FIG. 4C is a graph illustrating transmission and reflection of acoustic energy through the metamaterial silencer 100.

FIG. 4C is a graph illustrating the normalized amount of acoustic energy transmitted and the amount of acoustic energy reflected by a bilayer metamaterial silencer 300. As shown, at the target frequency of 460 Hz, very little acoustic energy is transmitted by the metamaterial silencer 300 (approximately less than 5%), while most of the acoustic energy is reflected by the metamaterial silencer 300 (approximately 94% or more).

Figure 4D:
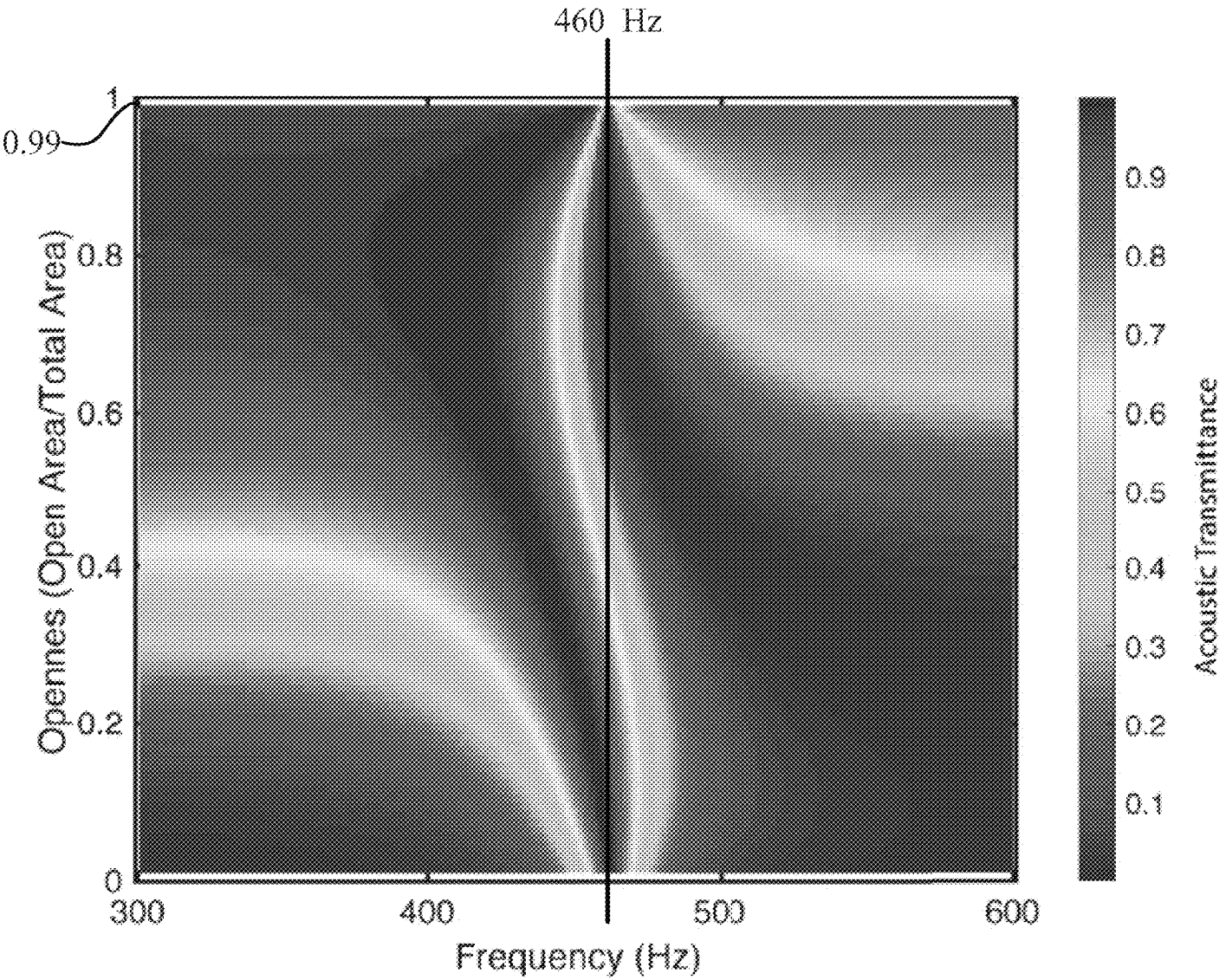
FIG. 4D is a graph illustrating acoustic transmittance through bilayer metamaterial silencers 100 with different degrees of structure openness.

FIG. 4D is a graph illustrating acoustic transmittance through bilayer metamaterial silencers 300 with different degrees of structure openness. Transmittance has been analytically derived using the Green's function method. Notably, bilayer metamaterial silencer structures considered herein feature identical refractive index ratios in their transverse bilayer metamaterial model but have different impedance ratios.

According to illustrative embodiments, openness percentage is correlated with the acoustic impedance ratio, and even with very high openness percentage, silencing can be realized within the scope of the presented embodiments. For example, as shown in FIG. 4D, even for bilayer metamaterial silencers 300 with a very high percentage of open area (approaching nearly complete open area where openness approximates 0.99 or 99%), the silencing functionality remains present, although with a resultant decrease in the silenced frequency bandwidth. The following table presents relationships between openness (open area/total area; in the column captioned "open:") and acoustic transmission (transmittance) at a variety of frequencies, as shown in FIG. 4D.

| Open: | 300 Hz | 350 Hz | 400 Hz | 460 Hz | 500 Hz | 550 Hz | 600 Hz |
|---|---|---|---|---|---|---|---|
| 0.99 | 0.90 | 0.90 | 0.90 | 0.01 | 0.77 | 0.77 | 0.77 |
| 0.8 | 0.80 | 0.85 | 0.85 | 0.10 | 0.35 | 0.6 | 0.65 |
| 0.6 | 0.85 | 0.85 | 0.88 | 0.20 | 0.10 | 0.25 | 0.30 |
| 0.4 | 0.50 | 0.50 | 0.60 | 0.60 | 0.10 | 0.10 | 0.15 |
| 0.2 | 0.20 | 0.20 | 0.25 | 0.85 | 0.25 | 0.10 | 0.05 |

Although the foregoing figures illustrate an embodiment of a silencer 200 with a target frequency of 460 Hz, embodiment are not limited to silencers with that target frequency. As described above, the target frequency of a silencer 200 may be established by specification of the silencer's parameters.

Figure 5B:
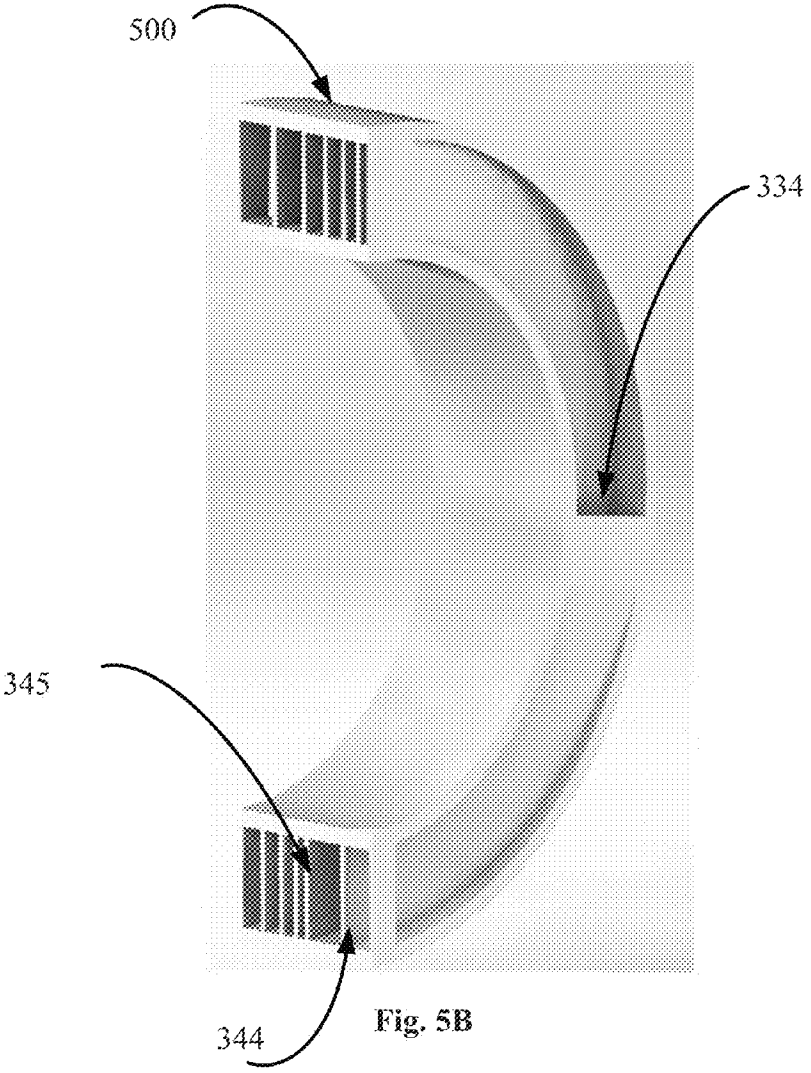
FIG. 5A and FIG. 5B schematically illustrate an alternate embodiment of a metamaterial sound silencer.
Figure 5A:
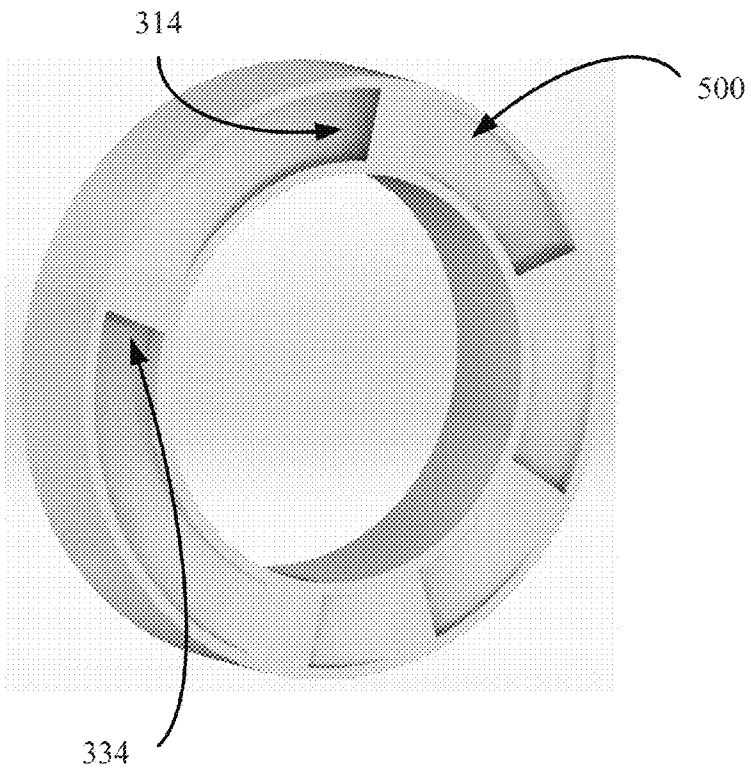

FIGS. 5A-5B: An Embodiment of a Cylindrical Metamaterial Silencer with Non-Uniform Channels FIG. 5A and FIG. 5B schematically illustrate another embodiment (500) of a metamaterial silencer 200. In this embodiment, the helical channels 341-346 in the second transmission region 220 do not have identical physical dimensions. For example, some helical channels are longer than others. To accommodate different channel lengths, the channel inlets 331-336 for the helical channels 341-346 are not uniformly distributed around the upstream face 221. Alternatively, or in addition, the channel outlets 351-356 are non-uniformly distributed around the downstream face 222. Moreover, the six channels 341-346 have different helix angles 347. In this design, given the different frontal angles of the channels, both effective length (and consequently refractive index, n) and cross sections (and consequently impedances, Z) are different. Therefore, this model of silencer may be designed to simultaneously target multiple frequencies with different silencing bandwidth.

Figure 6B:
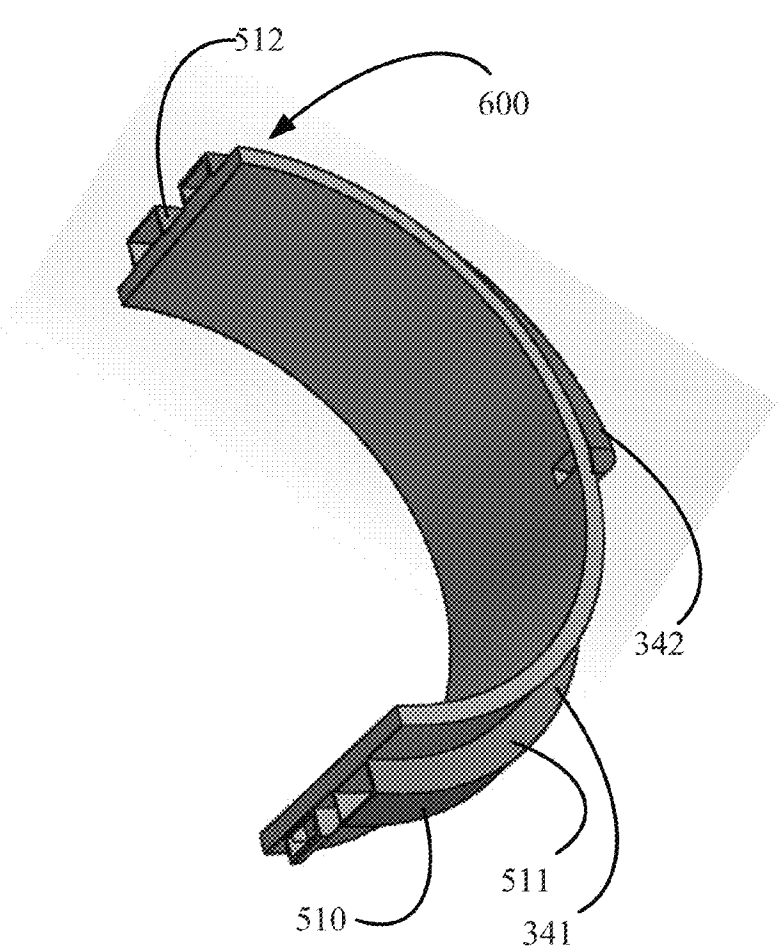
FIG. 6A and FIG. 6B schematically illustrate an alternate embodiment of a metamaterial sound silencer.
Figure 6A:
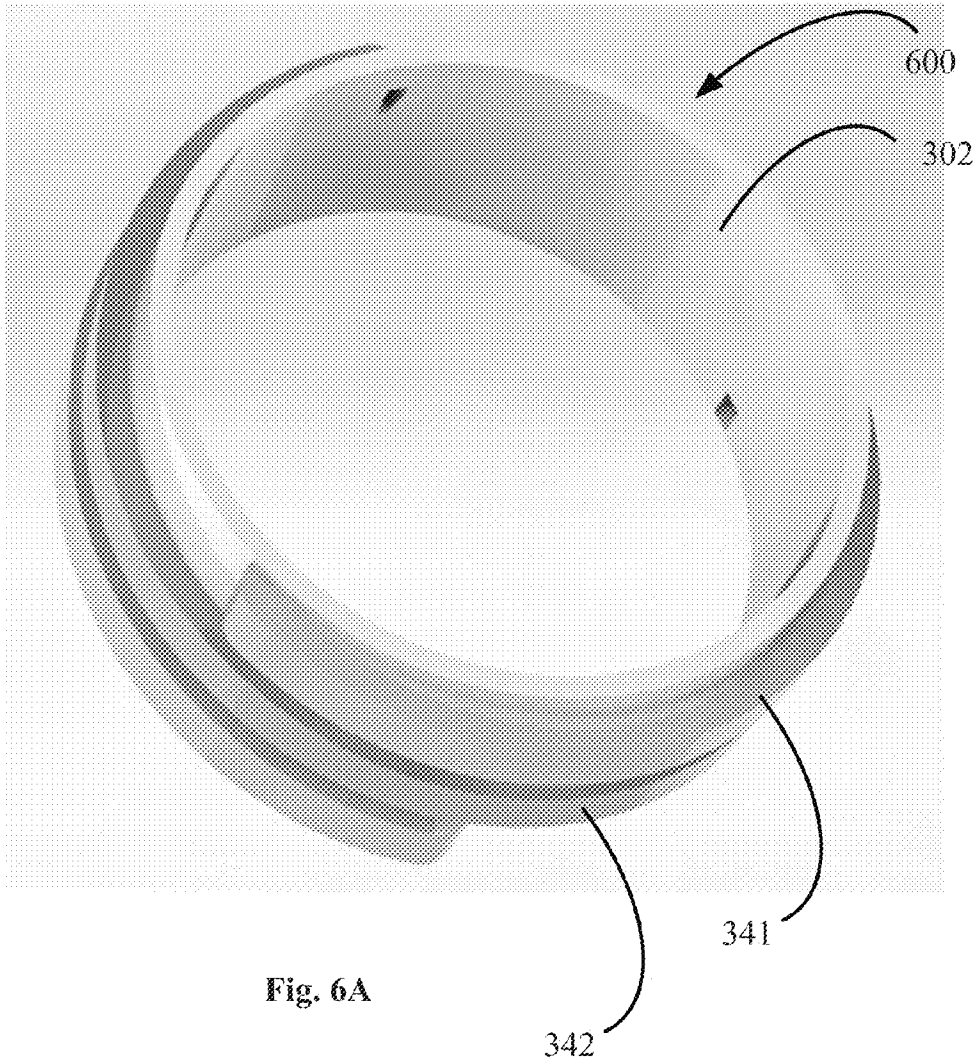

FIGS. 6A-6B: An Embodiment of a Cylindrical Metamaterial Silencer Having Radially Disposed Conduits FIG. 6A and FIG. 6B schematically illustrate another embodiment (600) of a metamaterial silencer 200. In this embodiment, the helical channels 341-342 in the second transmission region 220 include individual channel wrapped around an inner ring 302. Each individual channel 341, 342 has a top panel 610 and two side panels 611, 612. Each of the two side panels extends radially outward from the inner ring 302, and the top panel 610 extends between the radially outward ends of the two side panels 611, 612, to form a helical channel having a rectangular cross-section. The helical channels 341, 342 may be identical, or may have differing helix angles, and/or helix lengths, and/or different areas in cross-section. This embodiment may be desirable when the minimizing pressure loss in the central channel 210 is a goal. In this case, the channel inlet aperture 331, 332 and channel outlet apertures 351, 352, are arranged radially, and the silencer features two channels 341, 342 with different lengths (channel 342 has 0.75 revolution) (channel 341 has 1.1 revolutions). By adjusting the length of the channels and cross section of the channels the desired silencing, either multiband or single band with proper bandwidth may be realized.

Figure 7:
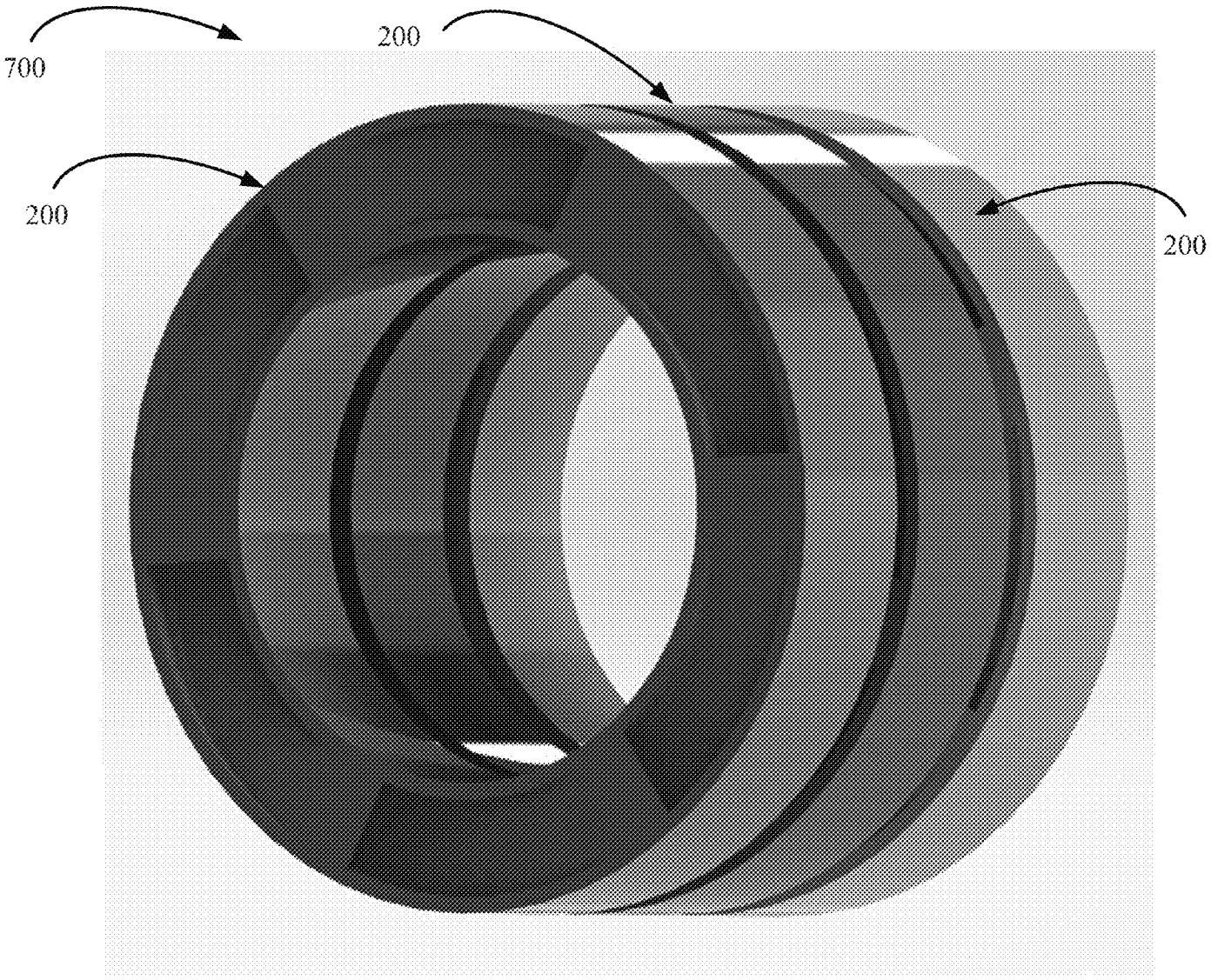
FIG. 7 schematically illustrates an embodiment of a silencer system having a plurality of metamaterial sound silencers disposed in series.

FIG. 7: An embodiment having Metamaterial Silencers Disposed in Series

FIG. 7 schematically illustrates a stack 700 of a plurality of metamaterial silencers 200, such as those illustrated in FIG. 3A. Each metamaterial silencer 200 may be configured to dampen a frequency different from the other two metamaterial silencers 200. The plurality of metamaterial silencers 200 in the stack 700 exhibit a synergy, such that the stack 700 is configured to dampen transmission of a plurality of target frequencies.

Figures 8A, 8B:
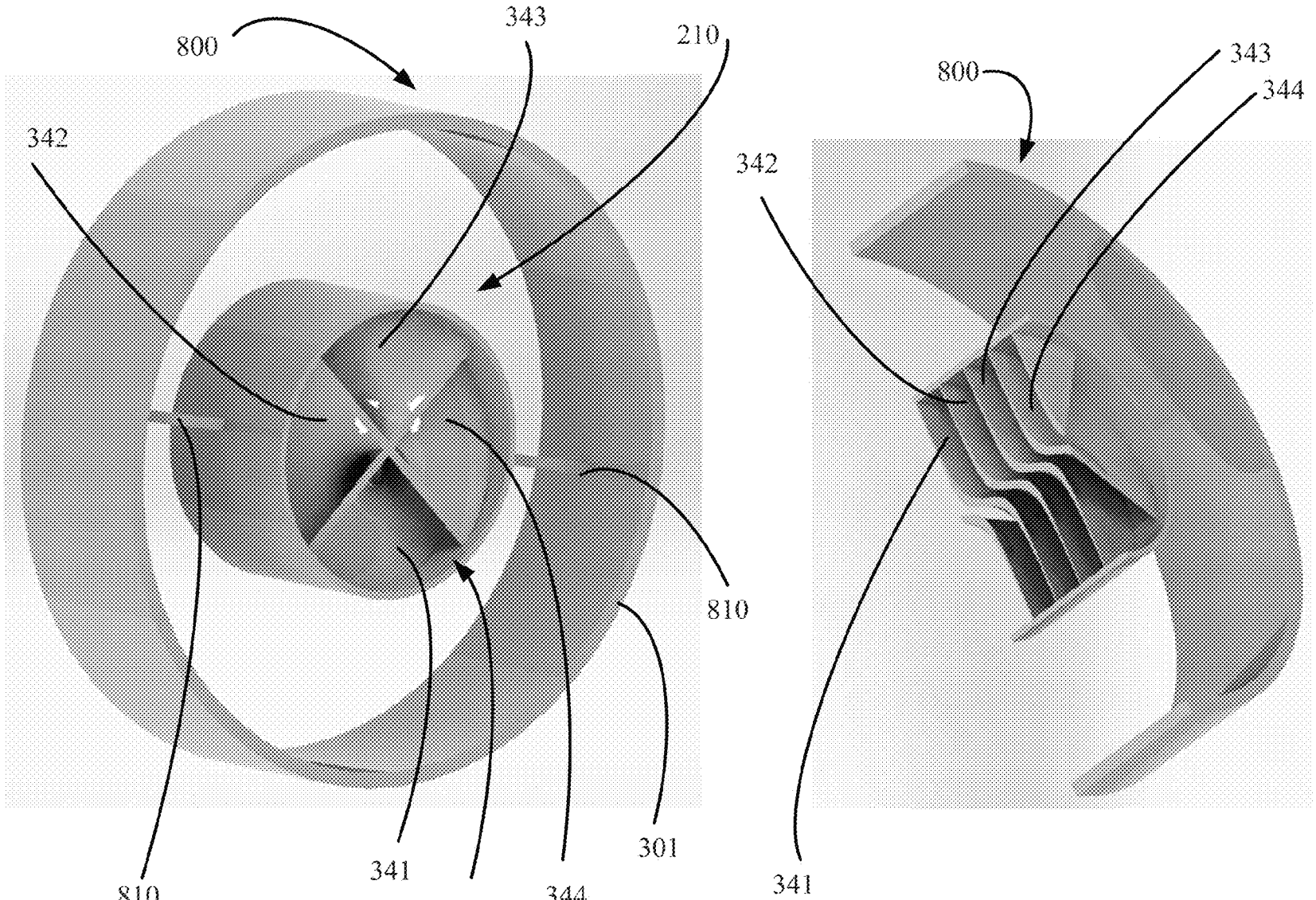
FIG. 8A and FIG. 8B schematically illustrate an alternate embodiment of a metamaterial sound silencer.

FIGS. 8A-8B: An Embodiment of a Cylindrical Metamaterial Silencer Having centrally-disposed Second Transmission Region FIG. 8A and FIG. 8B schematically illustrate another embodiment (800) of a metamaterial silencer 200. This embodiment includes a second transmission region 220, and a first transmission region 210 disposed radially outward of the second transmission region 220. The first transmission region 210 is bounded by an outer ring 301 and defines a non-resonating passage around the second transmission region 220. In this embodiment, the second transmission region 220 is a hub suspended from the outer ring 301 by one or more spars 810.

Figure 9A:
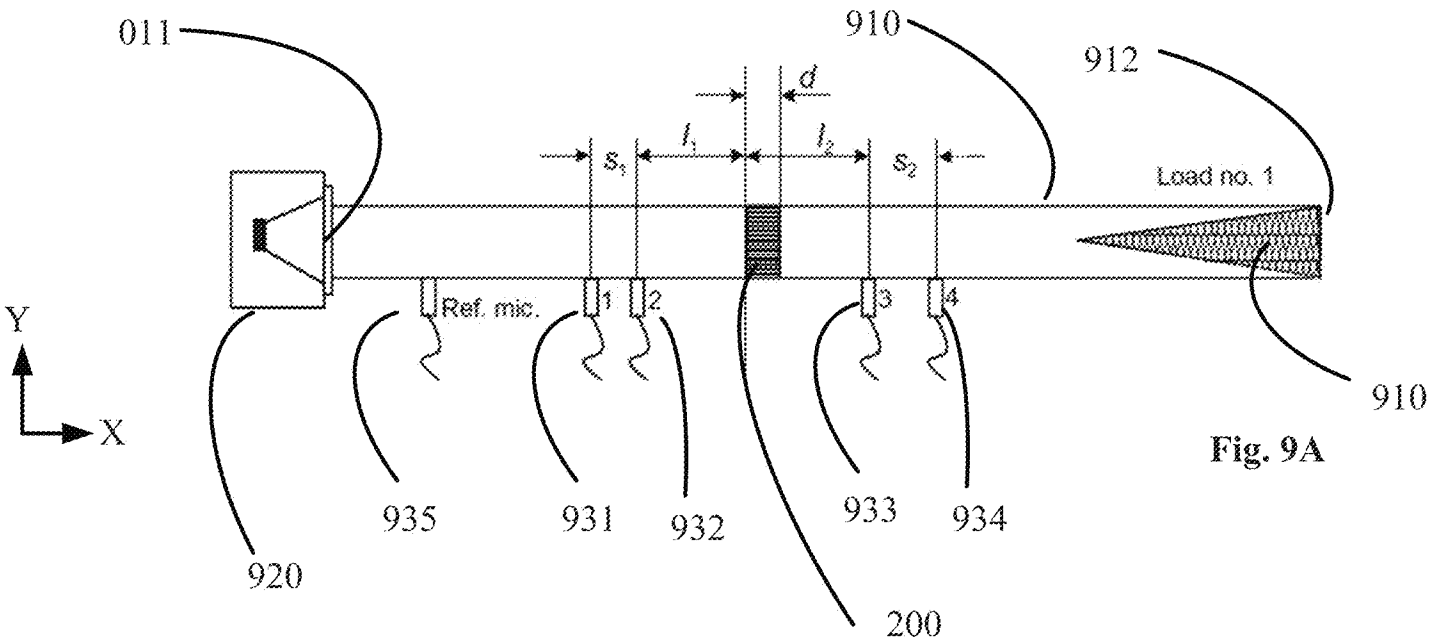
FIG. 9A schematically illustrates an embodiment of a metamaterial silencer disposed within a tube.
Figure 9B:
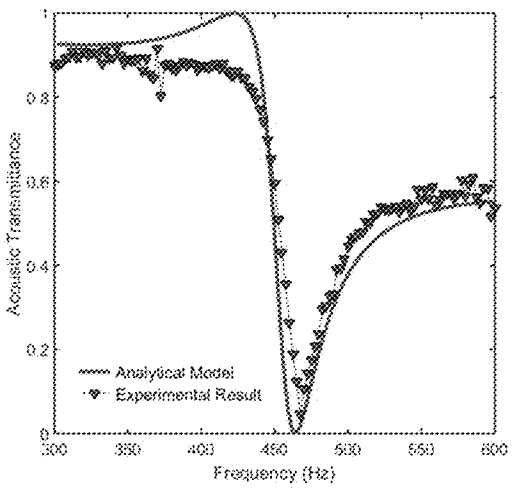
FIG. 9B is a graph showing the result of operation of the metamaterial silencer disposed within a tube.

FIGS. 9A-9B: An Embodiment of a Cylindrical Metamaterial Silencer disposed within a Tube Although embodiments described above (200; 300; 500; 600; 800) are un-ducted, and require an outer casing to produce the described performance and obtain the described results, illustrative embodiments may be disposed and used within a casing, as described in connection with FIG. 9A and FIG. 9B.

FIG. 9A schematically illustrates an embodiment of a metamaterial silencer 200 disposed within a tube 910. The metamaterial silencer 200 may be any of the cylindrical silencers disclosed herein. FIG. 9B is a graph showing the silencing effect of a metamaterial silencer 200 within a tube 910.

The tube 910 is a cylinder with two openings 911 and 912 at its ends. For purposes of illustration for this embodiment, a sound source (e.g., a loudspeaker) 920 is disposed at a first end 911 of the tube 910 such that a sound signal produced by the sound source 920 is directed into the tube 910 through the first opening, and then propagates down the tube 910 toward the second opening 912 at the other end of the tube 910. The sound signal in this embodiment has a spectrum that covers a range of frequencies, including the target frequency of the metamaterial silencer 200. An acoustic load 910 (which may be a cap, for example) is disposed in or over the aperture 912.

A metamaterial silencer 200 is disposed within the tube 910 with its upstream face 221 facing the sound source 920. The metamaterial silencer 200 in this embodiment has a target frequency of 460 Hz.

In FIG. 9A, the tube 910 is fitted with several microphones 931-935 disposed to measure the intensity of the sound signal at various points within the tube 910. Microphones 931, 932 and 935 are disposed upstream from the metamaterial silencer 200, and microphones 933, and 934 are disposed downstream from the metamaterial silencer 200. As shown in FIG. 9B, the metamaterial silencer 200 substantially dampens the sound signal at the target frequency (460 Hz), downstream from the metamaterial silencer. Specifically, the metamaterial silencer 200 transmits approximately 90% of the acoustic energy of the sound signal at frequencies below the target frequency, and transmits approximately 50% of the acoustic energy of the sound signal at frequencies above the target frequency, but transmits almost none (at or about zero percent) of the acoustic energy of the sound signal at the target frequency, and less than 50% of the acoustic energy of the sound signal in a band around the target frequency. Consequently, FIG. 9A and FIG. 9B illustrate that the metamaterial silencer 200 operates well even when its downstream face 122 is in bounded space instead of free space or unbounded space. For example, the operation of the metamaterial silencer 300 in unbounded space 205, as illustrated above, is also valid for operation in bounded space, such as inside the tube 910.

Figure 10A:
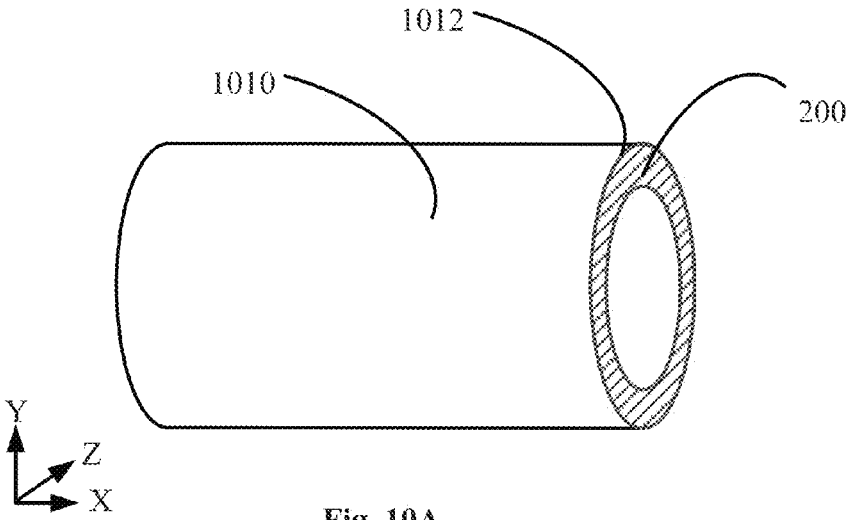
FIG. 10A schematically illustrates an apparatus having a metamaterial sound silencer.
Figure 10B:
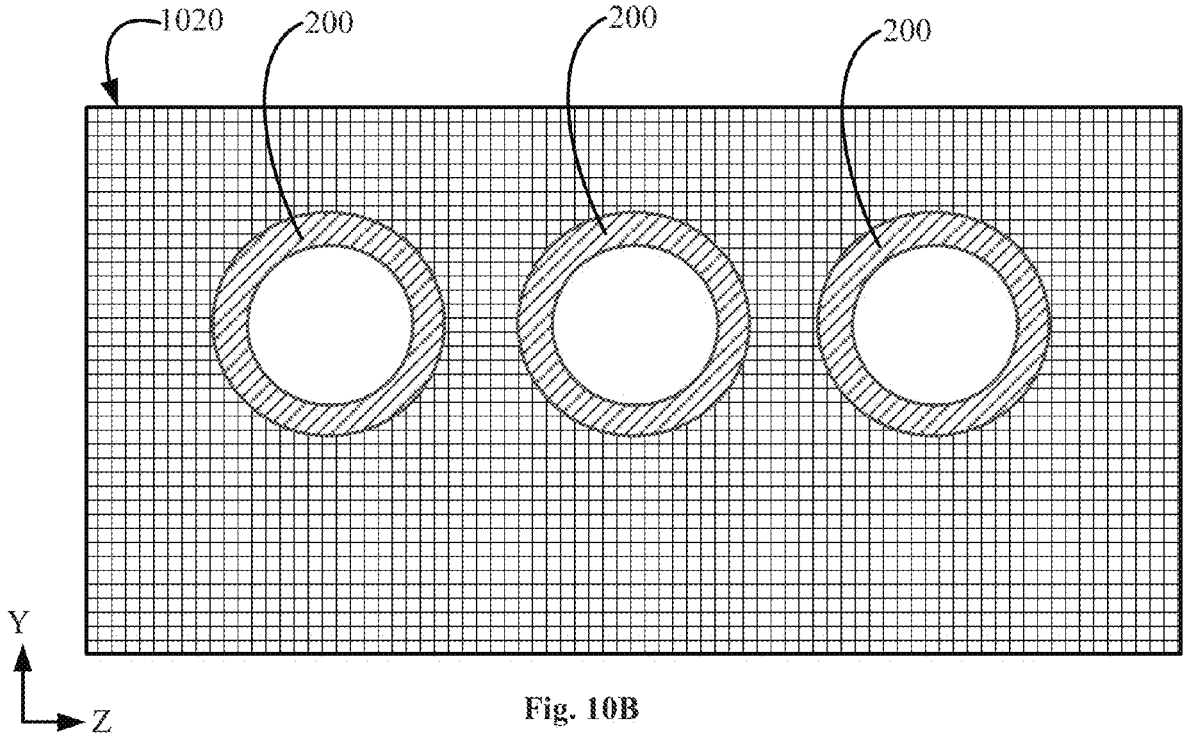
FIG. 10B schematically illustrates a barrier having a plurality of metamaterial sound silencers.

FIG. 10A and FIG. 10B: Embodiments of Practical Applications of Metamaterial Sound Silencers FIG. 10A and FIG. 10B schematically illustrate practical applications of various embodiments of a metamaterial silencer 200 (e.g., 300; 500; 600; 800). FIG. 10A schematically illustrates a metamaterial silencer 200 disposed at an outlet 1012 of a tube 1010. The tube 1010 may be, or include, a sound source. For example, the tube 1010 may be an exhaust pipe of a motor vehicle, or a jet engine, to name but a few examples. The metamaterial silencer 200 operates as described above to dampen noise exiting the tube 1010, yet allows the flow of gas (e.g., exhaust gas; jet blast) out of the tube 1010.

FIG. 10B schematically illustrates a sound barrier 1020 having a set of metamaterial silencers 200 (e.g., 300; 500; 600; 800). Each such metamaterial silencer 200 operates as described above to dampen noise impinging on the barrier 1020, yet allows the flow of gas through the barrier 1020. In some embodiments, a set of metamaterial silencers 200 is placed near ground level, so that animals may pass through the metamaterial silencers 200.

FIGS. 11A-11E: Embodiment of a Metamaterial Silencer in a Wheel

Figure 11B:
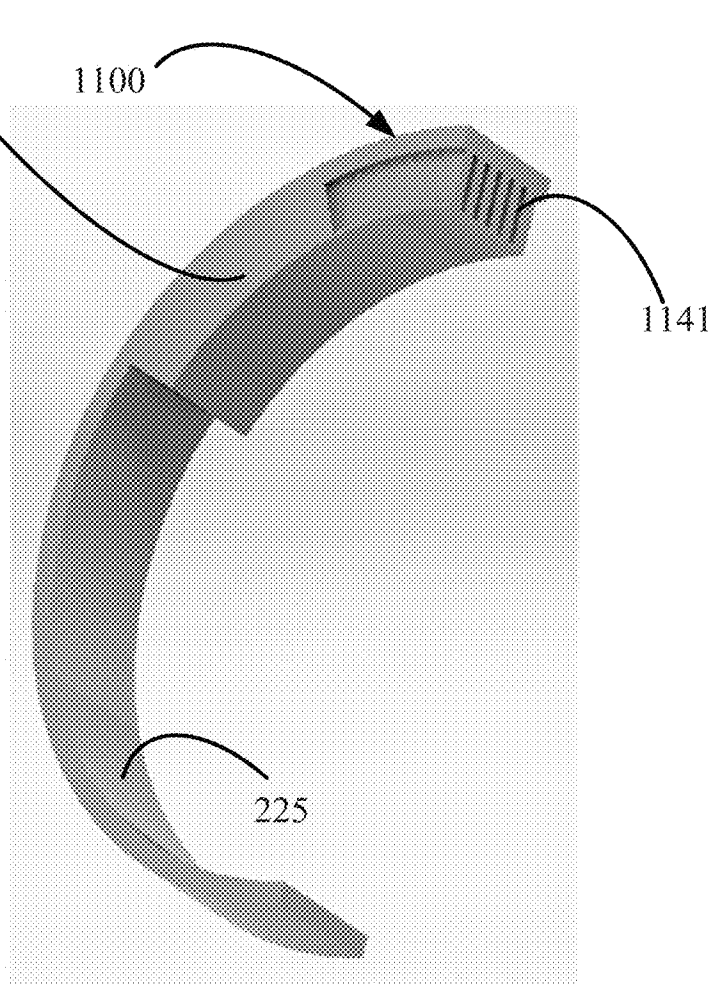
FIG. 11A and FIG. 11B schematically illustrate an alternate embodiment of a metamaterial sound silencer.
Figure 11A:
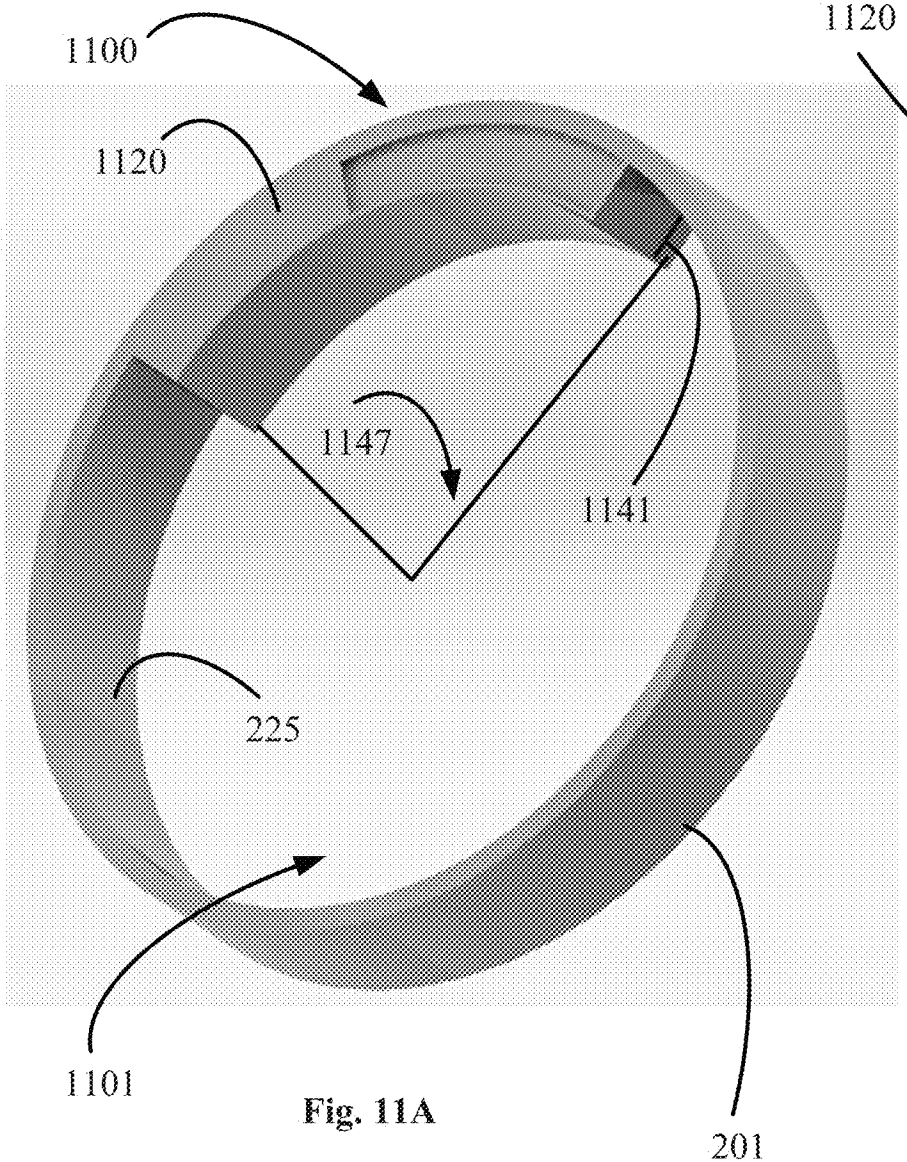

FIG. 11A and FIG. 11B schematically illustrate another embodiment of a metamaterial silencer 1100. This embodiment includes an outer ring 301 has an inner radial face 325, which defines an interior region 1101. An arc-resonator 1120 is disposed on the inner radial face 325, and includes one or more serpentine resonating channels 1141. In this illustrative embodiment, a single channel 1141 is wrapped in the arc-resonator 1120. The arc-resonator 1120 subtends and angle 1147 at the center at the outer ring 301, which angle in this embodiment is approximately 45 degrees. In other embodiments, the angle 1147 may be greater or less than 45 degrees, for example 30 degrees, 60 degrees, 90 degrees, or 120 degrees.

In operation, acoustic energy enters the channels 1141 and resonates within those channels. The acoustic energy then exits the arc-resonator 1120 and dampens acoustic energy within the interior region 1101.

One application for such an embodiment is within the wheel of a motor vehicle. To that end, FIG. 11C illustrates noise pressure within a sealed automobile wheel 1150. In this embodiment, a metamaterial silencer having three arc-resonators 1120 is disposed within the wheel 1150.

Figure 11E:
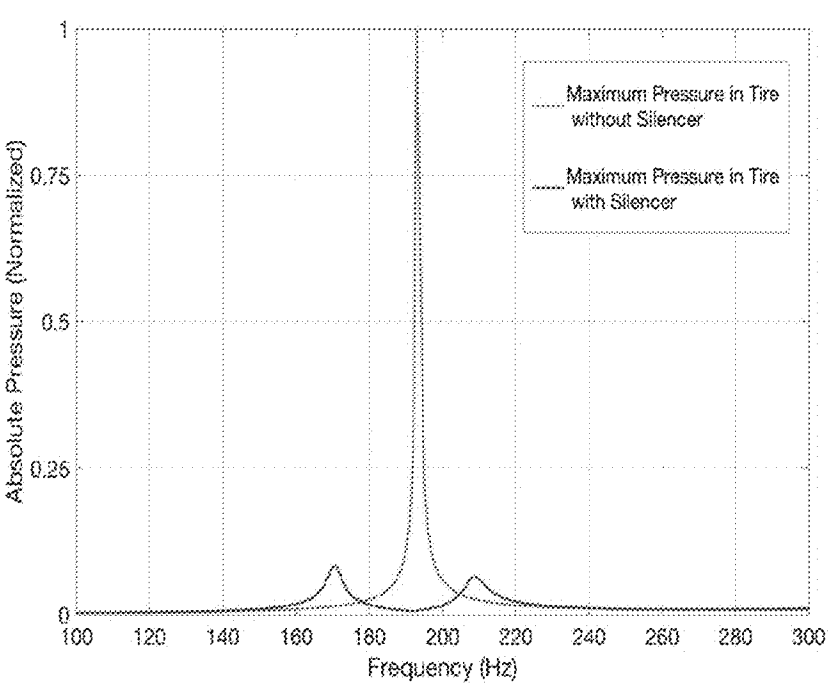
FIG. 11E is a graph illustrating pressure within the wheel, normalized to the pressure when the wheel does not have a metamaterial silencer 100 of FIG. 10A.

FIG. 11E is a graph 1160 that shows the pressure within the wheel, normalized to the pressure when the wheel does not have a metamaterial silencer 1100 of FIG. 11A. Trace 1161 shows that normalized pressure without the inclusion within the wheel 1150 of a metamaterial silencer 1100 of FIG. 11A. In contrast, trace 1162 shows the normalized pressure within the wheel 1150 when the metamaterial silencer 1100 of FIG. 11A is included within the wheel 1150, as schematically illustrated in FIG. 11D. As shown, inclusion within the wheel 1150 of the metamaterial silencer 1100 reduces acoustic pressure by approximately 90 percent.

Figure 11F:
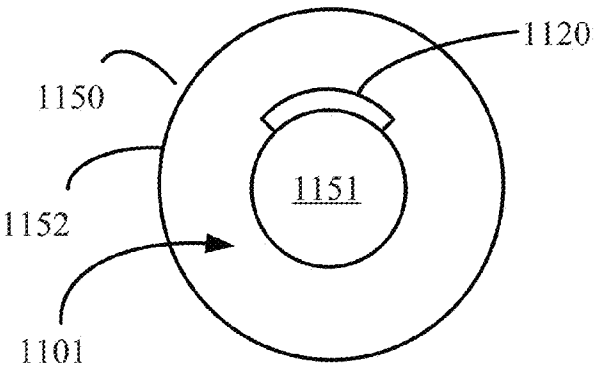
FIG. 11F schematically illustrates an embodiment of a metamaterial silencer disposed on the hub of a pneumatic wheel.
Figure 11C:
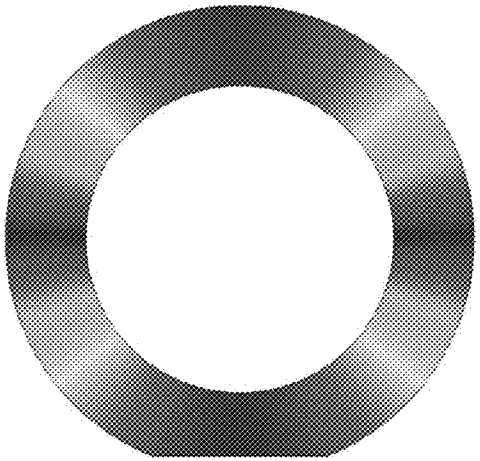
FIG. 11C is a graphic illustrating noise pressure within a sealed automobile wheel 750.
Figure 11D:
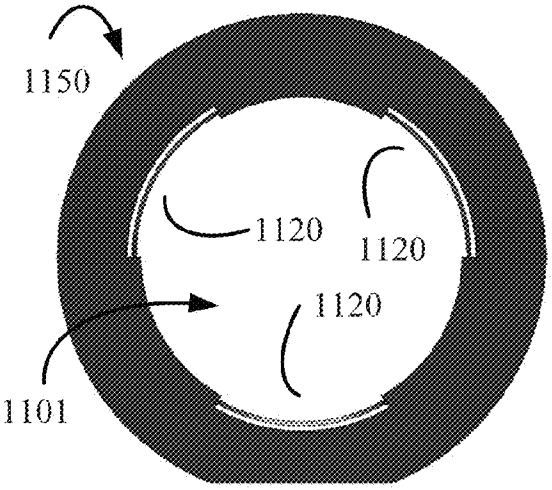
FIG. 11D is a graphic illustrating an embodiment of a metamaterial silencer disposed within a sealed pneumatic wheel.

FIG. 11F schematically illustrates an embodiment of a wheel 1150 having an arc-resonator 1120 disposed on its wheel hub 1171 and within a tire 1152 mounted to the hub.

A listing of certain reference numbers is presented below.

200: Metamaterial sound silencer;
205: Unbounded space;
210: First transmission region (or "through passage");
211: Direction of gas flow;
220: Second transmission region
221: Upstream face of metamaterial sound silencer;
222: Downstream face of metamaterial sound silencer;
223: Inner radius;
224: Outer radius;
301: Outer ring;
302: Inner ring;
325: Inner radial face of metamaterial sound silencer;
326: Outer radial face of metamaterial sound silencer;
327: Thickness;
328: Acoustically rigid member (or "acoustically rigid spacer");
331-336: Channel inlets;
341-346: Channels;
347: Helix angle;
351-356: Channel outlets;
810: Spar;
910: Acoustic load;
920: Sound source;
931-935: Microphones;
1010: Tube (e.g., hollow cylinder);
1011: First end of cylinder;
1012: Second end of cylinder;
1020: Barrier.
1101: Interior region;
1120: Arc-resonator;
1147: Arc angle;
1150: Wheel:
1151: Wheel hub;
1152: Tire.

Various embodiments may be characterized by the potential claims listed in the paragraphs following this paragraph (and before the actual claims provided at the end of this application). These potential claims form a part of the written description of this application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public.

Without limitation, potential subject matter that may be claimed (prefaced with the letter "P" so as to avoid confusion with the actual claims presented below) includes:

P1. A transverse bilayer apparatus for reducing transmission of an acoustic wave in a gaseous medium, the acoustic wave having a frequency and an associated wavelength, the apparatus comprising: a first transmission region defining a non-resonating passage, the non-resonating passage: defining a gas-flow axis, and being substantially open to flow of gas along the gas-flow axis; and having a first acoustic impedance (Z1) and a first acoustic refractive index (n1); a second transmission region, the second transmission region having: an upstream axial face; a downstream axial face opposite upstream face; and a thickness (t) being less than 50% of the wavelength; a set of helical resonator channels in the second transmission region, each helical resonator channel in the set of helical resonator channels having: an channel inlet aperture opening to the upstream axial face; a channel outlet aperture opening to the downstream axial face; a helix axis parallel to the gas flow axis; and a second acoustic impedance (Z2) and a second acoustic refractive index (n2); wherein the product of the second acoustic refractive index (n2) and the thickness (t) is equal to one half of the wavelength; and wherein the contrast (Z2/Z1) is at least one and less than 100.

P2. The transverse bilayer apparatus of P1 further comprising an acoustically rigid spacer disposed to acoustically separate the first transmission region from the second transmission region.

P3. The transverse bilayer apparatus of P2, wherein the acoustically rigid spacer comprises cylinder of acrylonitrile butadiene styrene plastic.

P4. The transverse bilayer apparatus of any of P1-P3, wherein: the upstream axial face is normal to the helix axis and the downstream axial face is normal to the helix axis.

P5. The transverse bilayer apparatus of P4, wherein: the second transmission region comprises an annular body having: an inner radius defining the non-resonating passage; and an outer radius defining a ring, the ring having the upstream axial face and the downstream axial face.

P6. The transverse bilayer apparatus of P5, wherein the non-resonating passage defines a first two-dimensional area (A1), and the upstream axial face define a second two-dimensional area (A2), and the ratio of the first two-dimensional area to the sum of the first two-dimensional area (A1) and the two-dimensional area (A2) is at least 0.6 (i.e., $A1/(A1+A2)\times100\geq60\%$).

P7. The transverse bilayer apparatus of any of P1-P6, wherein: the first transmission region is disposed radially outward of the second transmission region; and the non-resonating passage is disposed around the second transmission region.

P8. The transverse bilayer apparatus of P7, wherein the non-resonating passage has an annular shape around the second transmission region.

P9. The transverse bilayer apparatus of P7, further comprising: an outer ring disposed coaxially with and radially outward of the second transmission region, the outer ring defining a radially outward boundary of the non-resonating passage; and a set of spars extending from the outer ring to the second transmission region, and suspending the second transmission region from the outer ring.

P10. The transverse bilayer apparatus of any of P1-P9, further comprising: an outer ring having an inner surface and defining an interior region (1101); and wherein the second transmission region comprises and arc-resonator that subtends an angle of less than 365 degrees.

P11. The transverse bilayer apparatus of P10, wherein the arc-resonator subtends an angle less than 45 degrees.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. An apparatus comprising two or more metamaterial silencers, each such metamaterial silencer comprising a first channel open to the propagation of a target frequency therethrough and configured to remain in a continuum state during propagation of the target frequency therethrough, and a second channel open to propagation of the target frequency therethrough and configured to resonate at the target frequency, wherein said second channel is disposed, relative to said first channel, such that the target frequency of said second channel is capable of destructively interfering with the target frequency of said first channel;

wherein a first metamaterial silencer comprises a first channel configured to remain in a continuum state during propagation of a first target frequency therethrough and a second channel configured to resonate at the first target frequency, and wherein a second metamaterial silencer comprises a first channel configured to remain in a continuum state during propagation of a second target frequency therethrough and a second channel configured to resonate at the second target frequency;

wherein said second metamaterial silencer is disposed in series with said first metamaterial silencer; and wherein the first target frequency is different from the second target frequency.

2. The apparatus of claim 1, wherein each of the first metamaterial silencer and the second metamaterial silencer further comprises an acoustically rigid spacer disposed between the first channel and the second channel and capable of reducing transmission of acoustic energy between the first channel and the second channel.

3. The apparatus of claim 1, wherein the first channel is open to a flow of fluid therethrough.

4. The apparatus of claim 1, wherein the first channel defines an axis of fluid flow therethrough.

5. The apparatus of claim 1, wherein each second channel comprises a second outlet, and each such second outlet is an un-ducted outlet.

6. The apparatus of claim 1, further comprising:

a third metamaterial silencer, having a second channel configured to resonate at a third target frequency, the third metamaterial silencer disposed in series with said first metamaterial silencer and said second metamaterial silencer, to receive a wave comprising the third target frequency, wherein said third target frequency is different from said first target frequency and said second target frequency.

7. The apparatus of claim 1 wherein, for each of the first metamaterial silencer and the second metamaterial silencer:

the first channel has a first area in cross-section; and the second channel defines a second area in cross-section, and first area in cross-section is larger than the second area in cross-section such that the apparatus has an openness ratio of at least 0.8.

8. The apparatus of claim 1 wherein, for each of the first metamaterial silencer and the second metamaterial silencer:

the second channel is a helical channel disposed around the first channel.

9. The apparatus of claim 1 wherein for each of the first metamaterial silencer and the second metamaterial silencer:

the first channel is disposed radially outward of the each second channel.

10. The apparatus of claim 1 wherein:

each of the first metamaterial silencer and the second metamaterial silencer has a cylindrical shape having an upstream face on an upstream side and a downstream face on a side opposite the upstream side; and each of first metamaterial silencer and the second metamaterial silencer has a thickness corresponding to a cylinder height between the upstream face on an upstream side and a downstream face, the thickness being less than one quarter of a wavelength of the first target frequency and the silencer target frequency.

* * * * *